United States Patent [19]

Iwasaki

[11] Patent Number: 4,733,646

[45] Date of Patent: Mar. 29, 1988

[54] AUTOMOTIVE IGNITION SYSTEMS

[75] Inventor: Shimichiro Iwasaki, Troy, Mich.

[73] Assignee: Aisin Seiki Kabushiki Kaisha, Kariya, Japan

[21] Appl. No.: 857,299

[22] Filed: Apr. 30, 1986

[51] Int. Cl.[4] ..... F02P 3/09

[52] U.S. Cl. ..... 123/597; 123/598; 123/605; 123/637; 123/643

[58] Field of Search ..... 123/596, 597, 598, 604, 123/605, 606, 637, 634, 643

[56] References Cited

U.S. PATENT DOCUMENTS

| | | | |
|---|---|---|---|
| 3,407,795 | 10/1968 | Aiken et al. . | |
| 3,489,129 | 1/1970 | Issler et al. . | |
| 3,545,419 | 12/1970 | Naking . | |
| 3,581,726 | 6/1971 | Plume, Jr. | 123/598 |
| 3,677,253 | 7/1972 | Oishi et al. . | |
| 3,749,973 | 7/1973 | Canup . | |
| 3,779,226 | 12/1973 | Canup . | |
| 3,782,353 | 1/1974 | Kammerer et al. | 123/596 |
| 3,818,885 | 6/1974 | Canup . | |
| 3,820,520 | 6/1974 | Canup . | |
| 3,838,328 | 9/1974 | Lundy | 123/598 X |
| 3,853,106 | 12/1974 | Canup . | |
| 3,861,369 | 1/1975 | Canup . | |
| 3,910,246 | 10/1975 | Canup . | |
| 3,926,165 | 12/1975 | Merrick . | |
| 3,934,570 | 1/1976 | Asik et al. . | |
| 3,961,613 | 7/1976 | Canup . | |
| 3,976,043 | 8/1976 | Canup et al. | 123/637 X |
| 4,003,354 | 1/1977 | Canup | 123/606 X |
| 4,022,177 | 5/1977 | Canup et al. . | |
| 4,077,380 | 3/1978 | Canup . | |
| 4,097,770 | 6/1978 | Fisher | 123/597 |
| 4,131,100 | 12/1978 | Merrick . | |
| 4,136,301 | 1/1979 | Shimojo et al. . | |
| 4,174,695 | 11/1979 | Canup . | |
| 4,203,404 | 5/1980 | Canup . | |
| 4,261,318 | 4/1981 | Igashira et al. . | |
| 4,502,454 | 3/1985 | Hamai et al. | 123/597 |
| 4,516,558 | 5/1985 | Oohashi | 123/634 |

*Primary Examiner*—Tony M. Argenbright
*Attorney, Agent, or Firm*—Oblon, Fisher, Spivak, McClelland & Maier

[57] ABSTRACT

An automotive ignition system including an ignition capacitor electrically connected to a primary winding of a ignition transformer for providing energy to a spark plug which is connected to a second winding of the ignition transformer is disclosed. A charge circuit charges the ignition capacitor from a DC-DC voltage converter and includes an inductor and a thyristor. A discharge circuit discharges the ignition capacitor to the primary winding, and a control circuit operates the charge circuit and the discharge circuit in proper timed sequence during a demanded firing duration.

21 Claims, 96 Drawing Figures

$T_D$
$tw_1$
$td_1$
$td_2$
$tw_2$
$td_3$
$tw_3$
$V_{57}$
$V_{70}$
$V_{71}$
$V_{72}$
$V_{73}$
$V_{74}$
$V_{75}$
$V_{76}$
$V_{77}$

V26
0
V81
V84
tw1
td3
tw2
tw2

V87
Vr
0
td2
tw3

V82
0

I88
0

I85
0

I86
0

V86
VB
VSP
VS
0
OFF
ON
THYRISTOR 32

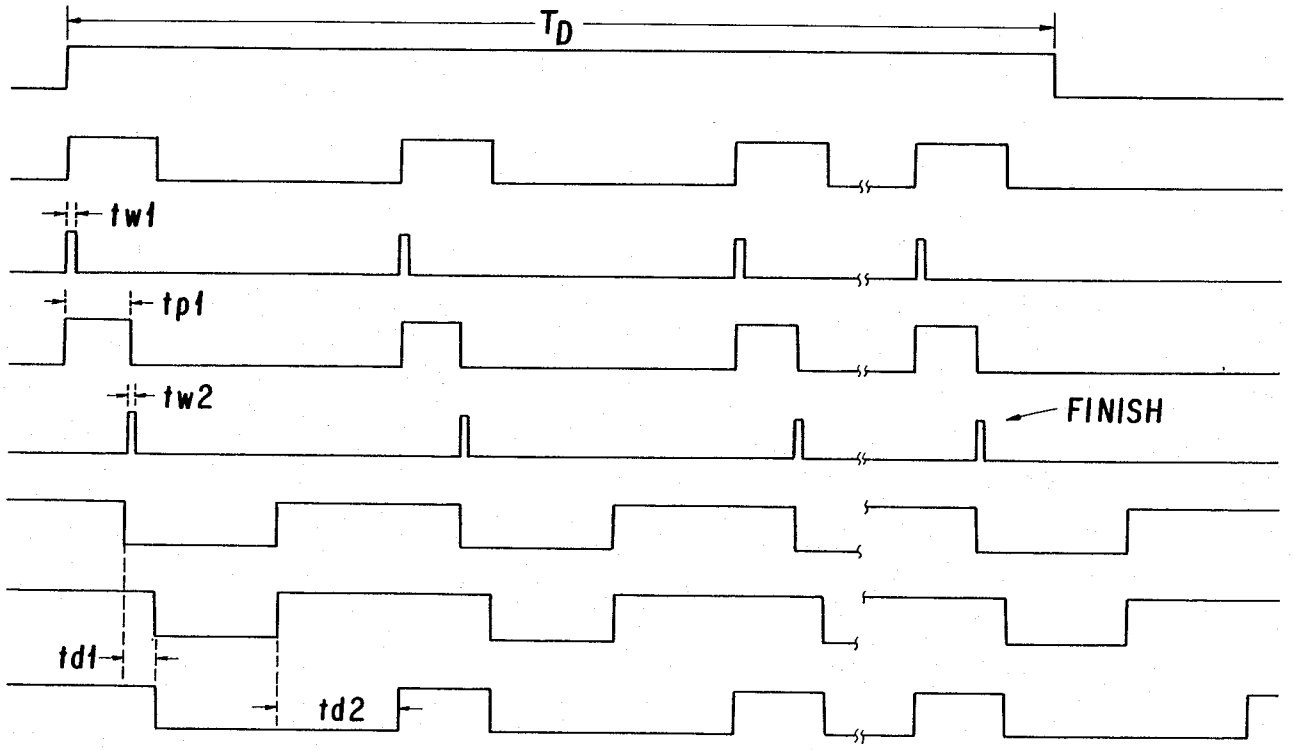
FIG. 14A $V_{57}$
FIG. 14B $V_{108}$
FIG. 14C $V_{75}$
FIG. 14D $V_{109}$
FIG. 14E $V_{71}$
FIG. 14F $V_{72}$
FIG. 14G $V_{110}$
FIG. 14H $V_{111}$

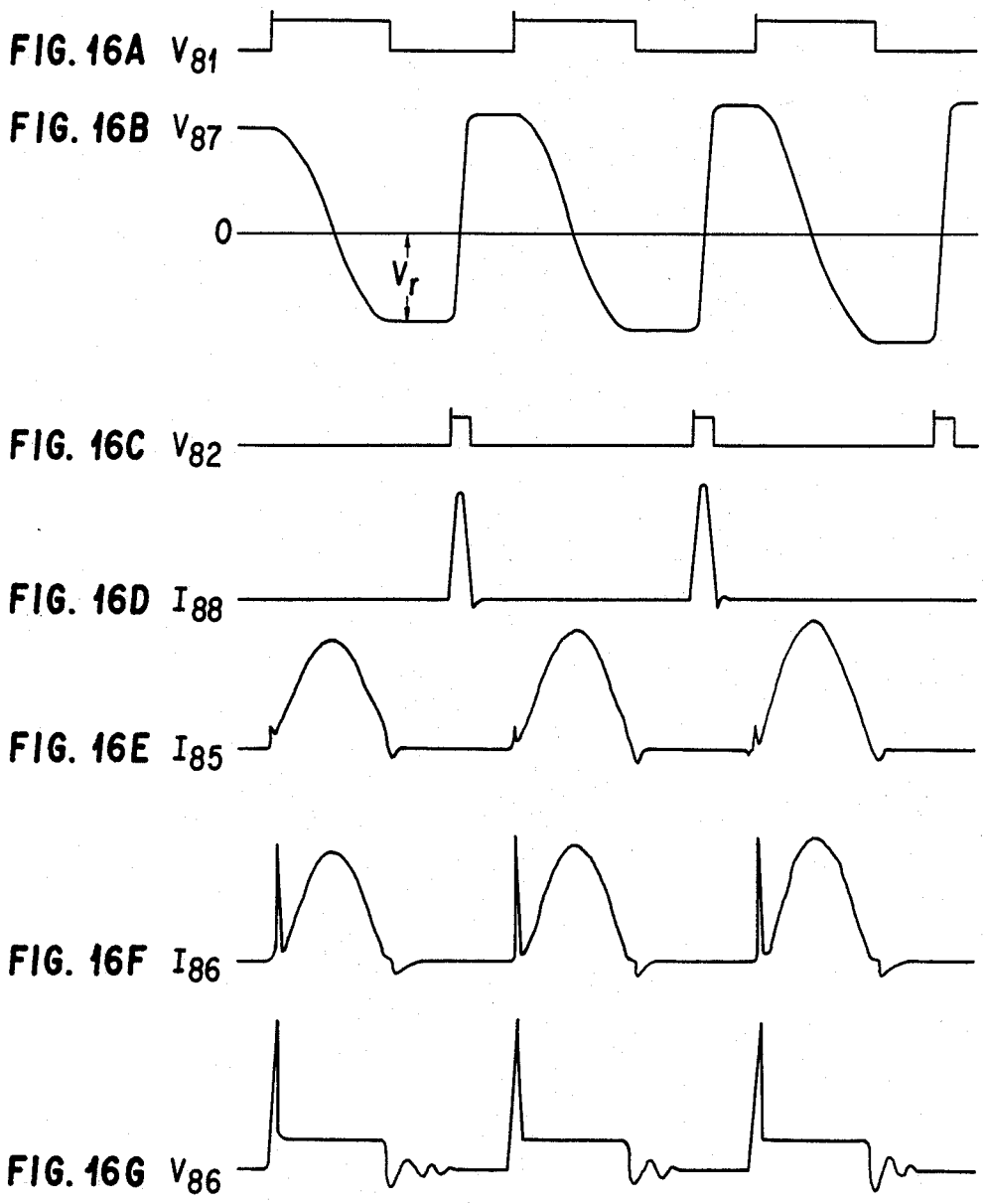
FIG. 16A $V_{81}$
FIG. 16B $V_{87}$
0
$V_r$
FIG. 16C $V_{82}$
FIG. 16D $I_{88}$
FIG. 16E $I_{85}$
FIG. 16F $I_{86}$
FIG. 16G $V_{86}$

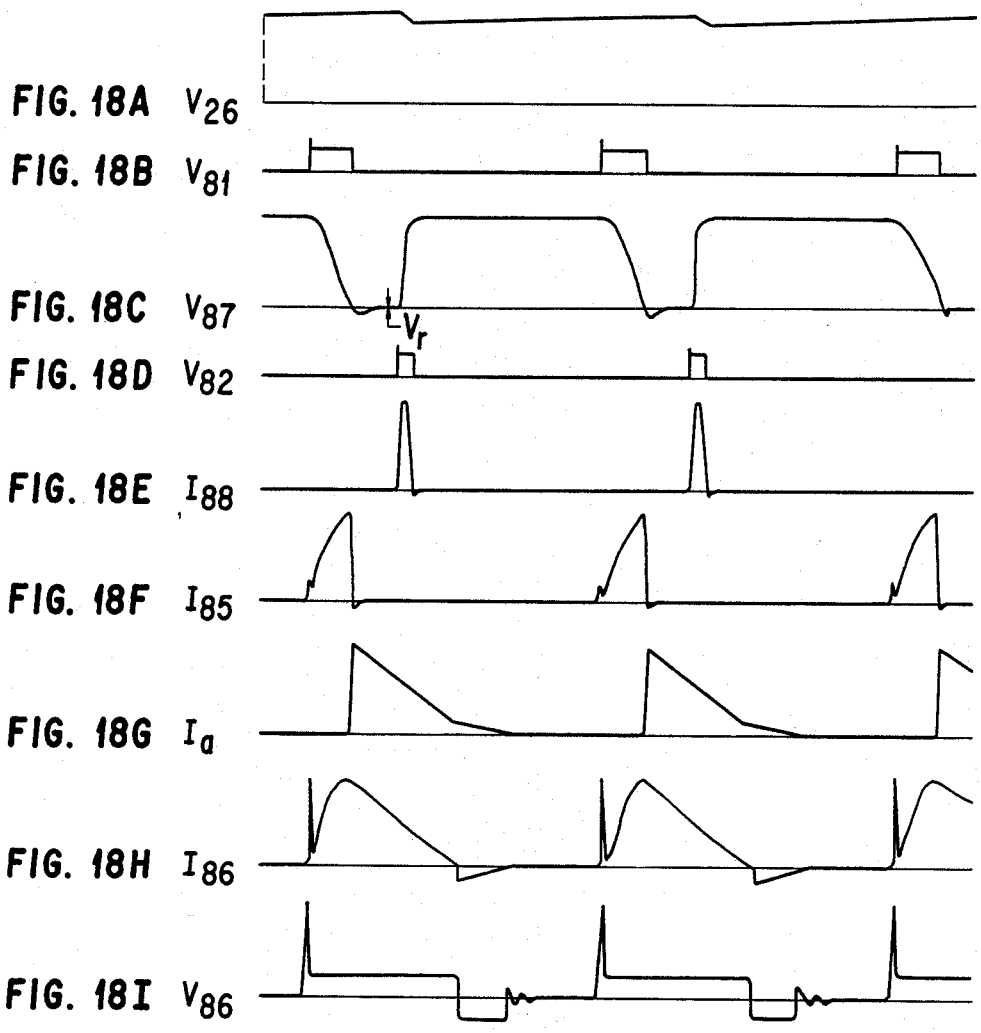
FIG. 18A $V_{26}$
FIG. 18B $V_{81}$
FIG. 18C $V_{87}$
$V_r$
FIG. 18D $V_{82}$
FIG. 18E $I_{88}$
FIG. 18F $I_{85}$
FIG. 18G $I_a$
FIG. 18H $I_{86}$
FIG. 18I $V_{86}$

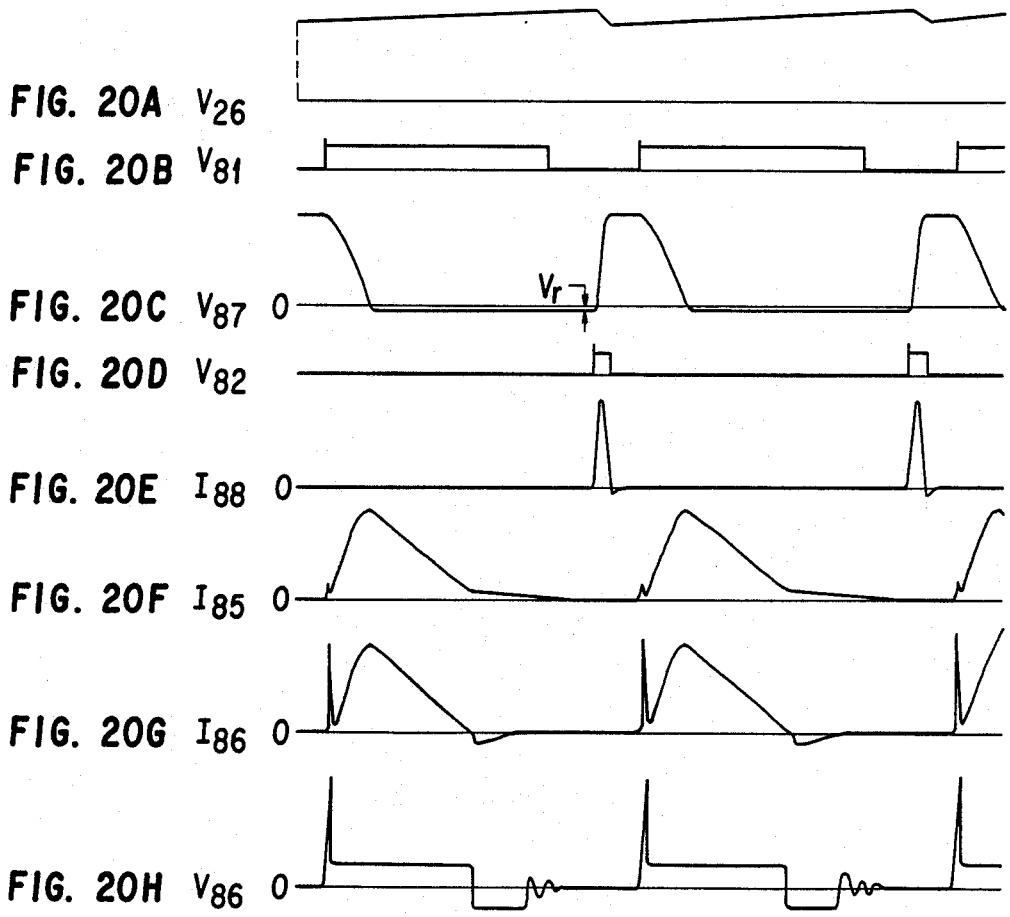
FIG. 20A $V_{26}$
FIG. 20B $V_{81}$
FIG. 20C $V_{87}$ 0
$V_r$
FIG. 20D $V_{82}$
FIG. 20E $I_{88}$ 0
FIG. 20F $I_{85}$ 0
FIG. 20G $I_{86}$ 0
FIG. 20H $V_{86}$ 0

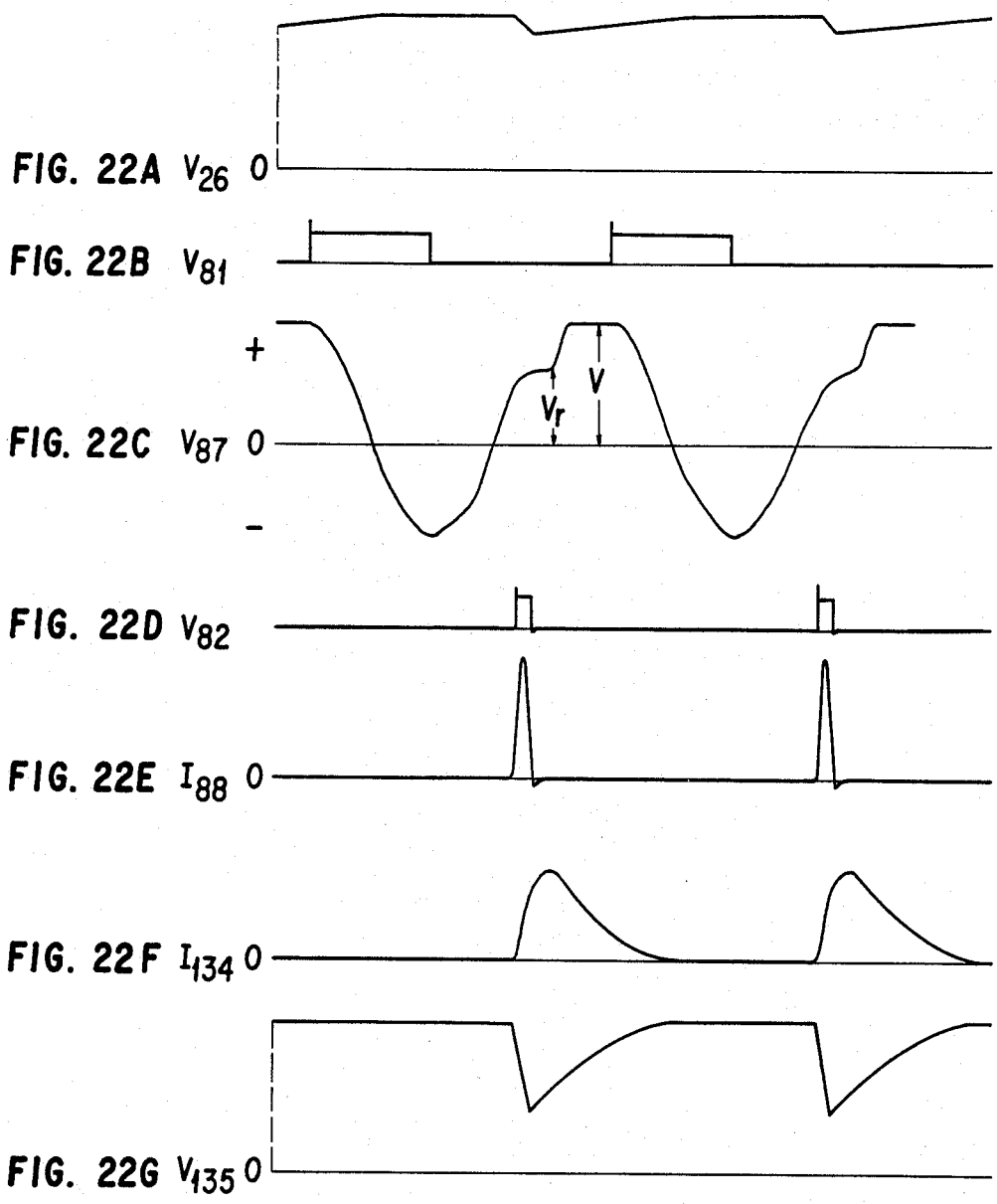
FIG. 22A $V_{26}$ 0
FIG. 22B $V_{81}$
+
FIG. 22C $V_{87}$ 0
-
$V_r$
V
FIG. 22D $V_{82}$
FIG. 22E $I_{88}$ 0
FIG. 22F $I_{134}$ 0
FIG. 22G $V_{135}$ 0

$V_{26}$ 0

$V_{81}$ $V_{87}$ 0
+
-

$V_{82}$ $I_{88}$ 0

$I_{85}$ 0

$I_{86}$ 0

$V_{86}$ 0

AUTOMOTIVE IGNITION SYSTEMS

BACKGROUND OF THE INVENTION

1. Field of the Invention

This invention relates generally to automotive ignition systems, and more specifically to a multistrike ignition system which produces a train of ignition sparks at the spark gaps of an internal combustion engine in proper timed sequence during a demanded firing duration, which is defined as the lapsed time during which multisparks will occur at the spark plug.

2. Description of the Prior Art

A conventional multi-strike ignition system is disclosed in the U.S. Pat. No. 3,489,129, wherein a charge circuit for charging a ignition capacitor from a DC voltage converter includes a resistor and a first thyristor used as a charge switch. A discharge circuit, for discharging the ignition capacitor to a primary winding of a ignition transformer, has a second thyristor used as a iischarge switch. After the first thyristor is turned on, a charge current flows to the ignition capacitor from the DC voltage converter via the resistor and the first thyristor for a period of time determined by the time constant of the combination of the ignition capacitor and the resistor. As the result, the first thyristor operated as the charge switch cannot be turned off until the current flowing through the first thyristor is reduced due to the characteristic of the thyristor. The conditions necessary to turn off the thyristor include whether the current flowing through the thyristor is very small or whether a reverse voltage is applied to the thyristor. Therefore, the interval for charging the ignition capacitor is much longer and hence a timing for discharging the lgnition capacitor to the primary winding of the ignition transformer is delayed whereby the duty cycle of the multistrike spark is reduced.

Furthermore, in the conventional ignition system, a timed sequence control for operating the charge circuit of the ignition capacitor and the discharge circuit of the ignition capacitor is operated by an oscillator which oscillates with a predetermined frequency without regard to the states of the thyristors.

Therefore, if the first thyristor is operated as a charge switch it may to be turned on by the oscillator in spite of the turned on state of the second thyristor which is being operated as the discharge switch. This is due to the turned on period of the second thyristor when misfiring occurred at the spark plug. The primary winding of the ignition transformer is directly loaded with the DC voltage from the DC voltage converter, whereby the DC voltage converter is fully discharged. Subsequently, the recovery time of the DC voltage converter, to return to the predetermined firing voltage is much longer and, therefore, the spark plug cannot be fired during this recovery time.

In the conventional multi-strike ignition system, the firing duration is fixed to a predetermined value and is independent of the rotational speed of the engine. In order to stabilize engine combustion and reduce the consumption of electrical energy, a firing duration control, in response to the rotational speed, is required. For example, the firing duration may be increased in response to the decrease in the rotational speed of the engine because the compressed fuel air mixture within the combustion chamber of the engine is less combustible at low speed conditions due to a low mixture swirl speed or low temperature of the combustion chamber.

Conversely the firing duration may be made to decrease in response to the increasing of the rotational speed of the engine because the compressed fuel-air mixture within the combustion chamber of engine is more combustible at high speed condition of engine due to the high temperature in the combustion chamber.

Additionally, in the conventional multi-strike ignition system, and especially the multi-strike ignition system using the ignition capacitor, the ignition transformer is a high leakage inductance type transformer having a air gap. The type of transformer which has an air gap is generally used in an inductive discharge ignition system which stores the spark energy in the form of magnetic energy in the air gap. This particular type of transformer is often used as a part fo a capacitive discharge ignition system having the above described ignition capacitor. The transformer is used because of the economic considerations.

The air gap is necessary in order to provide storage of energy in the inductive discharge ignition system. On the other hand in capacitive discharge ignition systems which utilize the ignition capacitor, the air gap is not necessary in order to store energy because the transformer operates in that particular mode, as an energy transmitter instead of an energy storage device. Although leakage inductance of the ignition transformer due to the proper air gap is necessary for capacitive discharge ignition systems, because primary current flows through the primary winding of the ignition transformer is produced by the resonance of the leakage inductance and the ignition capacitance. Thus, spark current (reflection of primary current) may be of a correct value due to the correct leakage inductance value. However, it is to be noted that this kind of leakage inductance dependency has disadvantages with respect to the size of the transformer, because the voltage across the primary winding is too high even for the sustaining period. This means a large size core cross-section is required.

If the air gap which is utilized for leakage inductance of the ignition transformer in the capacitive discharge system is deleted, another problem occurs with respect to the low leakage inductance. Since the primary current is too high and the spark duration for one pulse is too short.

SUMMARY OF THE INVENTION

It is an object of the present invention to avoid the aforementioned and other disadvantages of conventional ignition systems.

Accordingly, one object of the present invention is to provide an improved ignition systems accomplishing a higher duty of multi-strike spark discharge in the demanded firing duration.

Another object of the present invention is to provide an ignition system for controlling the firing duration in response to the rotational speed of engine in order to stabilize engine combustion and reduce electrical energy consumption.

Furthermore, it is an object of the present invention to provide an ignition system which can use a small-sized ignition transformer, and particularly, non-mechanical distributor ignition systems which requires no high voltage distributor.

These and other objects are accomplished by the ignition system of the present invention which includes a DC-DC voltage converter as a DC power source, a ignition capacitor electrically connected to the DC-DC voltage converter, an ignition transformer having its primary winding electrically connected to the ignition capacitor, a spark plug electrically connected to the secondary winding of the ignition transformer, a charge circuit for charging the ignition capacitor from the DC-DC voltage converter, a discharge circuit for discharging the ignition capacitor to the primary winding of the ignition transformer and a control circuit for operating the charge circuit and the discharge circuit in a proper timed sequence in the demanded firing duration, wherein the DC-DC voltage converter has a large value capacitor for storing enough energy as a regulated DC voltage. The charge circuit has a first inductor and a first thyristor operated as a charge switch and the discharge circuit has a choke coil and a second thyristor operated as a discharge switch. The ignition transformer, which has its primary winding electrically connected to the choke coil is a low leakage inductance type which has no air gap between the opposed surfaces of the core of the ignition transformer, and which has a control circuit with a firing duration decision circuit for deciding the firing duration in response to the rotational speed of engine and which also has a means for detecting the off-state of the discharge circuit and generatlng a signal driving a charge circuit after the off-state of the second thyristor is detected.

Consequently, in the present invention, the duty of the multi-strike spark discharge can be much higher due to the ignition capacitor being charged by the first inductor and the first thyristor of the charge circuit. This is true because the current waveform of the first thyristor is a pulse whereby the current flowing in the first thyristor is immediately decreased so as to turn off the first thyristor. Furthermore, the voltage of the ignition capacitor, charged from the DC-DC voltage converter via the first inductor and the first thyristor, is higher than that of the DC-DC voltage converter due to the function of the inductance of the first inductor whereby the first thyristor has a reverse voltage and thus the first thyristor is charged so as to immediately turn off.

Furthermore, in the present invention, the driving of the charge circuit and the discharge circuit in the proper timed sequence can start immediately after the turned off state of the discharge circuit. Therefore, there is no need to provide a long period of time for considering the possibility that the discharge circuit is off. Also, the simultaneous driving of the charge circuit and the discharge circuit is prevented.

The present invention also stabilizes engine combustion and reduces the consumption of electrical energy because the firing duration for the multi-strike discharge is controlled in response to the rotational speed of engine by the control circuit.

The present invention utilizes a small sized ignition transformer which has a low leakage transformer. This is possible because of the choke coil usage whereby the spark current of the spark gap is supplied by discharging of the ignition capacitor via the choke coil with the following approximate resonant frequeny $f_i$:

$$fi = \frac{1}{2\pi\sqrt{LC}}$$

where,

L: the inductance of the choke coil

C: the capacitance of the ignition capcitor And, the approximate peak value Ip of the spark current is defined by the following equation:

$$Ip = \frac{V}{\sqrt{\frac{L}{C}}} \times A$$

where,

V: the charged voltage of the ignition capcitor

A: the turn ratio of the ignition transformer

Therefore, by the combination of the choke coil and the low leakage inductance transformer the spark current flows for a predetermined duration which is determined by the resonant frequency, and the peak of spark current is limited by the inductance of the choke coil whereby the ignition transformer in the present invention is not required to have high leakage inductance for storing the electrical-magnetic energy. The ignition transformer in the present invention operates only as a means for transferring the energy and the cross-sectional area S of the core in the ignition transformer is defined by the following equation:

$$S = \frac{E}{2fi \cdot N \cdot Bm}$$

where,

E: applied voltage

N: turn number at the primary winding of the ignition transformer

Bm: magnetic flux density of core of the ignition transformer

As the result, the cross-sectional area of the core is inversely proportional to the resonance frequency, whereby the size of the ignition transformer required can be decreased by increasing the resonant frequency.

The above and other objects, features and advantages of the present invention will become more apparent from the following description when taken in conjunction with the accompanying as shown by way of illustrative examples.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 14A–14H provide a series of curves showing the voltage characteristics at various selected places throughout the circuitry of repetition rate control circuit disclosed in FIG. 13;

FIGS. 16A–16G are a series of curves showing the voltage and current characteristics at various selected places throughout the circuitry disclosed in FIG. 15;

FIGS. 18A–18I are a series of curves showing the voltage and current characteristics at various selected places throughout the circuitry of FIG. 17;

FIGS. 20A–20H are a series of curves showing the voltage and current characteristics at various selected places throughout the circuitry of FIG. 19;

FIGS. 22A–22G are a series of curves showing the voltage and current characteristics at various selected places throughout the circuitry of FIG. 21;

DETAILED DESCRIPTION OF THE PREFERRED EMBODIMENTS

Figure 1:
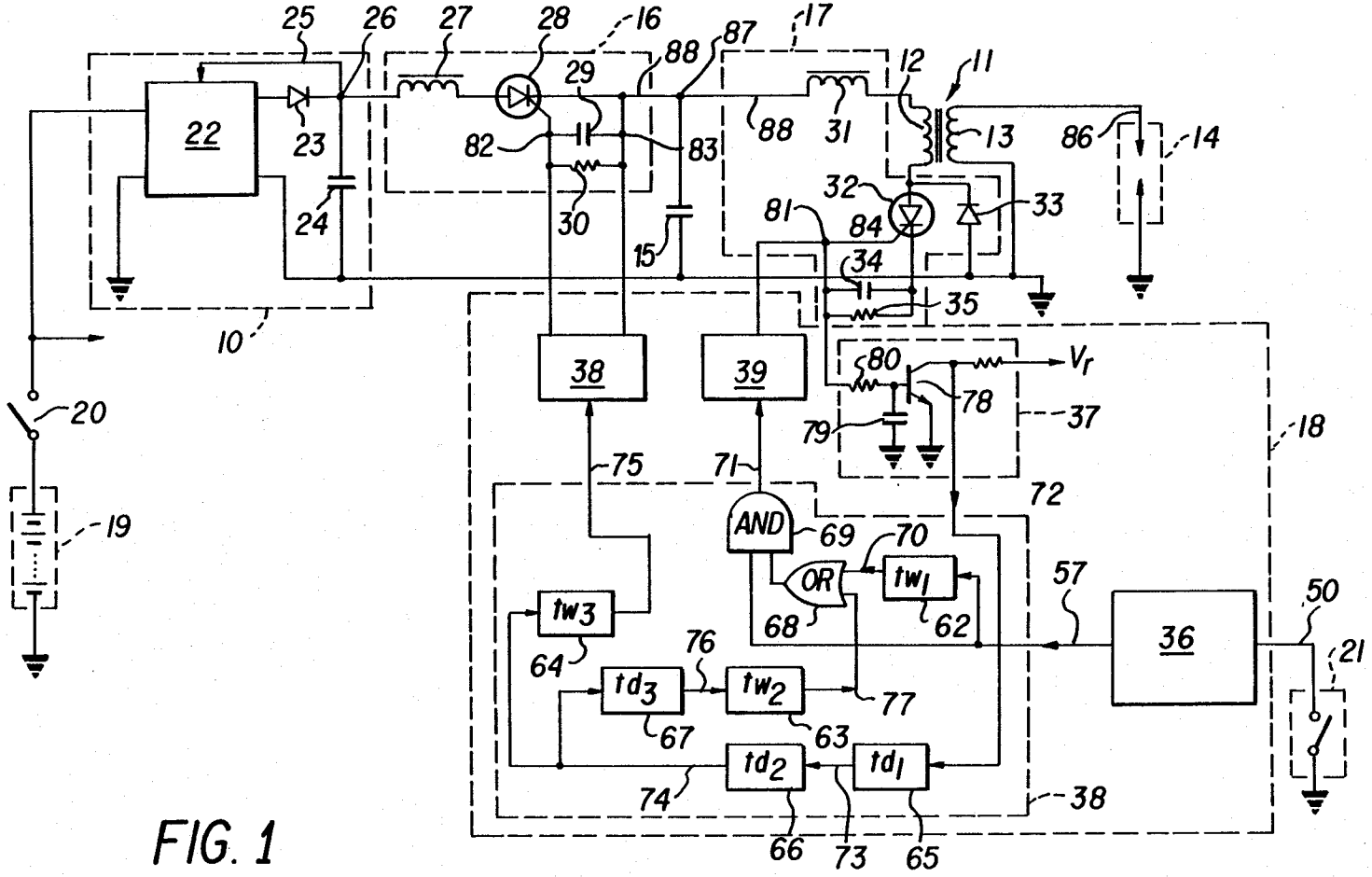
FIG. 1 is a circuit diagram showing the operating circuit elements as well as their interconnections according to the present invention.

Referring now to the drawings, wherein like reference numerals designate identical or corresponding parts throughout the several views, and more particularly to FIG. 1 thereof, there is shown an automotive ignition system including a DC-DC voltage converter 10 acting as a DC power source, a ignition transformer 11 having a primary winding 12 and a secondary winding 13, a spark plug 14 connected with the secondary winding 13, a ignition capacitor 15 electrically connected to the primary winding 12, a charge circuit 16 for charging the ignition capacitor 15 from the DC-DC voltage converter 10, a discharge circuit 17 for discharging the ignition capacitor 15 to the primary winding 12, and control circuit 18 for operating the charge circuit 16 and the discharge circuit 17 in proper timed sequence during the demanded firing duration. The reference numerals 19, 20, 21 indicate respectively, a battery for supplying the power (DC 12 V) to the circuits 10 and 18, a ignition switch and a breaker point.

The DC-DC converter 10 includes a swinging choke inverter 22, a diode 23 and a first capacitor 24 having a large capacitance, for example, 100 (μF). The DC-DC converter 10 stores a predetermined voltage generally DC 400 (V) which is higher than that of battery 19 due to the functioning of the swinging choke inverter 22. The voltage of the first capacitor 24 is regulated to the predetermined value because the voltage at the first capacitor 24 is feedback to the swinging choke inverter 22 via a feedback line 25. Therefore, if the voltage at the first capacitor 24 is dropped, swinging choke inverter 22 is driven by the feedback signal so as to replenish the voltage at the first capacitor 24. An output voltage $V_{26}$ of DC-DC voltage converter 10 exists at junction 26.

The charge circuit 16 includes a first inductor 27 of inductance 100 (μH), a first thyristor 28 operated as a charge switch, and a capacitor 29 and resistor 30 for increasing the noise margin in order to drive the first thyristor 28.

The discharge circuit 17 includes a choke coil 31 of inductance 1 (mH), a second thyristor 32, a diode 33, and a capacitor 34 and resistor 35 for increasing the noise margin to drive the second thyristor 32 and to detect the on-off state of the second thyristor 32.

The control circuit 18 includes a firing duration decision circuit 36 for deciding the demanded firing duration, a detecting circuit 37 for detecting on-off state of the second thyristor 32, a repetition rate control circuit 38 for operating the charging circuit 16 and the discharging circuit 17 with a proper timed sequence during the demanded firing duration, a first driving circuit 38′ for driving the first thyristor 28 and a second driving circuit 39 for driving the second thyristor 32.

Figure 2:
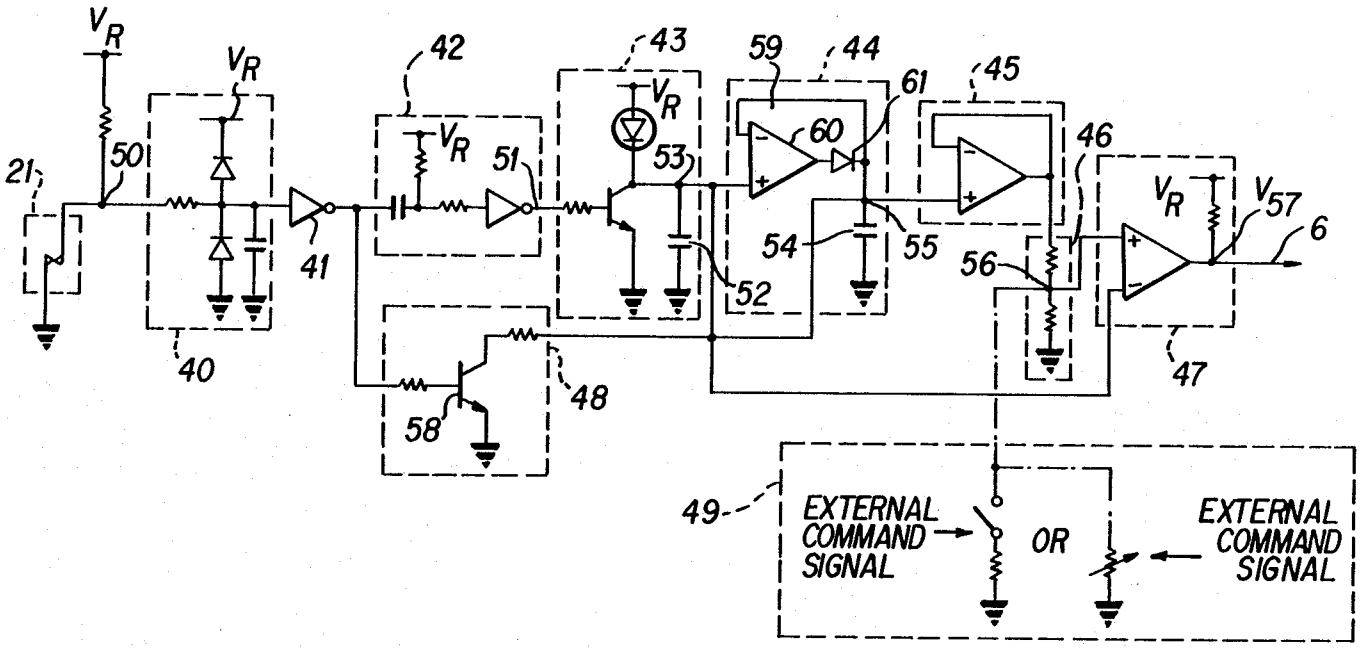
FIG. 2 illustrates details of the firing duration decision circuit disclosed in FIG. 1.

As shown in FIG. 2, the firing duration decision circuit 36 includes an input protection and filter circuit 40, an inverter 41, a one-shot multivibrator 42, a ramp generator 43, a peak hold circuit 44, a voltage follower 45, a voltage divider 46, a comparator 47, a peak cancel circuit 48, and an external spark crank angle controller 49 for controlling the output of the voltage divider 46 in response to a external commanded signal being, in turn, changed in response to an engine condition, for example, the engine temperature and load conditions, etc.

At a junction 50, the breaker point 21 generates a signal $V_{50}$. The period T (of the signal $V_{50}$) is defined by the following equation:

$$T = \frac{120}{n \cdot m} \text{ (sec.)}$$

where n: engine speed (rpm)

m: number of cylinder

During the period T of the signal $V_{50}$, the signal $V_{50}$ is at a high level during time $T_A$ when the breaker point 21 is to be opened and is at a low level during time $T_B$ when the breaker point 21 is to be closed.

The rising edge of the high level of the signal $V_{50}$ indicates the starting time of the firing duration, and the period T of the signal $V_{50}$ is inversely proportional to the engine speed.

Figure 3:
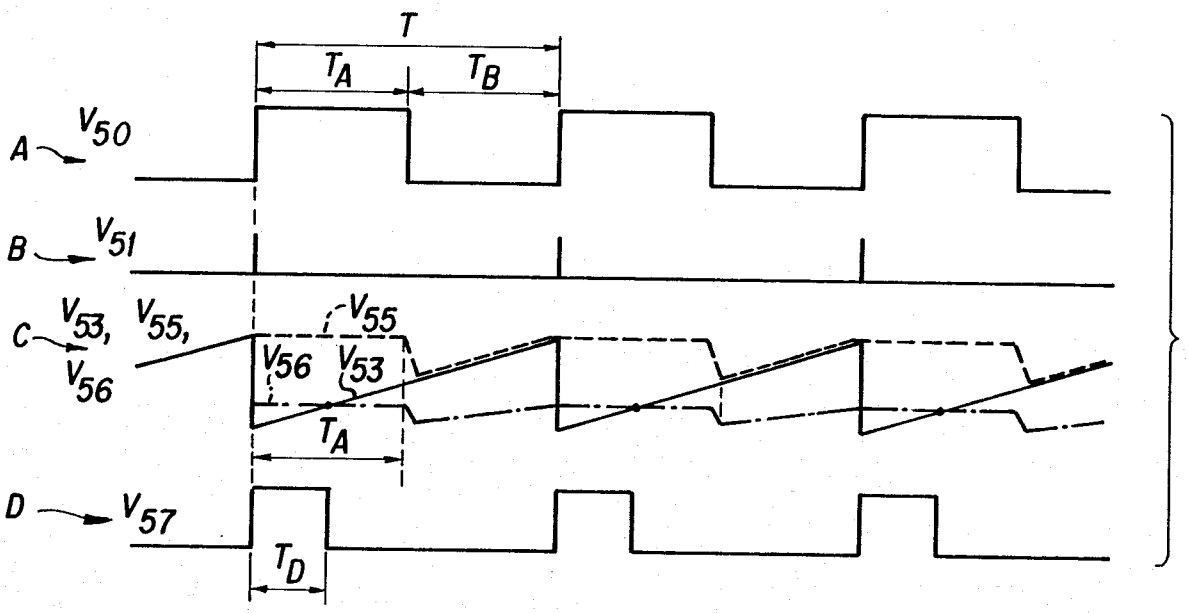
FIGS. 3A–3D provide a series of curves showing the voltage characteristics at various selected places throughout the circuitry of FIG. 2.

The signal $V_{50}$ is transmitted to the one-shot multivibrator 42 and the peak cancel circuit 48 via the circuit 40 and inverter 41. The one-shot multivibrator 42 generates a trigger voltage $V_{51}$ at a point 51 when the high level of signal $V_{50}$ rises, as shown in FIG. 3B. Upon the occurrence of signal $V_{50}$, the ramp generator 43 starts to charge capacitor 52 with predetermined time constant. The voltage $V_{53}$ at a junction 53 is the charged voltage of capacitor 52. This voltage increases in response to the lapsed time of the signal $V_{50}$, as shown in FIG. 3C. The voltage $V_{53}$ is transmitted to an inverting input of the comparator 47.

A capacitor 54 of peak hold circuit 44 memorizes the peak value of a previous voltage $V_{53}$ and generates a voltage $V_{55}$ as shown in FIG. 3C at a junctlon 55. The voltage $V_{55}$ is transmitted to the voltage divider 46 via the voltage follower 45. The voltage divider 46 divides the voltage $V_{55}$ to 10–15 percent thereof and generates a voltage $V_{56}$ at a junction 56.

The comparator 47 compares the voltage $V_{56}$ with the voltage $V_{53}$ and generates a firing duration signal $V_{57}$ at a junction 57 until the voltage $V_{56}$ is higher than the voltage $V_{53}$. The duration $T_D$ in the firing duration signal $V_{57}$ as shown in FIG. 3D indicates the demanded firing duration. The duration $T_D$ is proportional to Period T and expressed as follows:

$$T_D = K \cdot T$$

K: dividing ratio of divider (10–15 percent)

A transistor 58 in the peak cancel circuit 48 is turned on when the signal $V_{50}$ is no longer at a high level thus cancelling the voltage $V_{55}$ and replacing it with the voltage $V_{53}$ via a peak detector 59 being formed by an operational amplifier 60 and a diode 61 until signal $V_{50}$ reaches a high level as shown in FIG. 3A. When the high level of the signal $V_{50}$ occurs, the transistor 58 is turned off and thus the voltage $V_{55}$ is kept to the peak value of voltage $V_{53}$. The firing duration decision circuit 36 generates the firing duration signal $V_{57}$ in precise response to the engine speed due to the firing duration signal $V_{57}$ being based on the signal $V_{50}$ which indicates the engine speed.

The repetition rate control circuit 38, as shown in FIG. 1, includes one-shot multivibrators 62, 63 and 64 for generating a trigger when the rising edge of an input signal is detected, a delay circuit 65 for delaying the falling edge of input signal, delay circuit 66 and 67 for delaying the rising edge of an input signal, an OR circuit 68 and an AND circuit 69.

The firing duration signal $V_{57}$ at the output of circuit 36 is applied to the one-shot multivibrator 62 and to one input of AND circuit 69. The one-shot multivibrator 62 detects the rising edge of signal $V_{57}$ and generates the output voltage trigger $V_{70}$ shown at a point 70 in FIG. 1 and as $V_{70}$ in FIG. 4B.

Figures 4A, 4B, 4C, 4D, 4E, 4F, 4G, 4H, 4I:
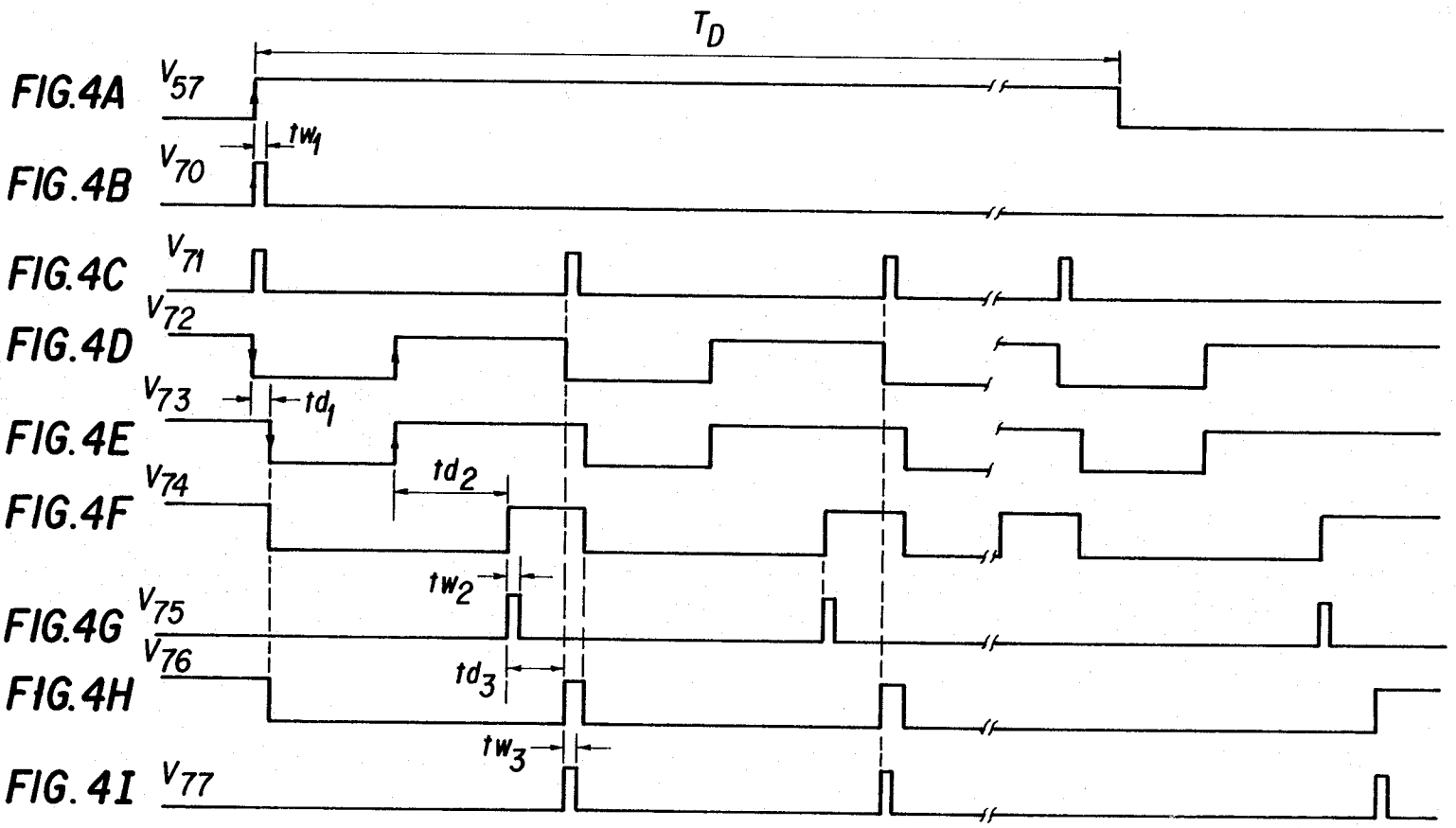
FIGS. 4A–4I show a series of curves showing the voltage characteristics at various selected places throughout the circuitry of repetition rate control circuit disclosed in FIG. 1.

The trigger $V_{70}$ is applied to the AND circuit 69 via the OR circuit 68. The AND circuit 69 generates a trigger $V_{71}$ as shown in FIG. 4C. This trigger $V_{71}$ operates the second thyristor 32 via the second drive circuit 39. The delay circuit 65 detects the output $V_{72}$ at the point 72. The output $V_{72}$ is at a high level when the second thyristor 32 is to be turned off, while, on the other hand, the output $V_{72}$ drops to a low level when the second thyristor 32 is to be turned on, as shown in FIG. 4D. The delay circuit 65 detects the falling edge of output $V_{72}$ and generates a signal $V_{73}$ at output 73 with a delay time td1 as shown in FIG. 4E. The delay circuit 66 detects the rising edge of signal $V_{73}$ and generates a signal $V_{74}$ at output 74 with delay time td2 as shown in FIG. 4F. The signal $V_{74}$ is applied to the one-shot multivibrator 64 and the delay circuit 67. The one-shot multivibrator 64 generates a trigger signal $V_{75}$ with pulse width tw3 at place 75. This trigger signal $V_{75}$ operates the first thyristor 28 via the first drive circuit 38'.

The delay circuit 67 detects the rising edge of signal $V_{74}$ and generates a signal $V_{76}$ at point 76 with the delay time td3 as shown in FIG. 4H. The signal $V_{76}$ is applied to the one-shot multivibrator 63. The one-shot multivibrator 63 generates a trigger signal $V_{77}$ with pulse width tw2 at place 77 as shown in FIG. 4I. This trigger $V_{77}$ is applied to the AND circuit 69 via the OR circuit 68. Therefore, during signal $V_{57}$ is at a high level trigger $V_{71}$ is generated by the trigger voltages $V_{70}$ and $V_{77}$. However, if the firing duration signal $V_{57}$ goes to low level, the trigger $V_{71}$ is not generated by the function of the AND circuit 69. Likewise, the trigger 75 is not generated when the firing duration signal $V_{57}$ goes to low level. In the repetition rate control circuit 38 of FIG. 1, the trigger $V_{75}$ is generated after the off state of second thyristor 32 is detected.

The detecting circuit 37 for detecting the on-off state of second thyristor 32 includes a transistor 78, a capacitor 79 and resistor 80 for increasing noise margin to detect the on-off state of the second thyristor 32. When the hold current for holding the on state of second thyristor 32 flows between the anode and the cathode of second thyristor 32, the second thyristor 32 is kept in the on state in spite of the absence of trigger $V_{71}$. During the on state of second thyristor 32, the gate voltage $V_{81}$ of second thyristor 32 at the junction 81 is sufficient to turn the transistor 78 on. Therefore, the ouput $V_{72}$ of detecting circuit 37 changes to the high level voltage from the low level voltage when the second thyristor 32 changes to the off state from the on state, as shown in FIG. 4D.

The gate voltage $V_{81}$ of second thyristor 32 has temperature coefficient. The transistor 78 has a temperature coefficient of its P-N junction (base-emitter) nearly equal to that of the P-N junction (anode-cathode) in the second thyristor 32. As the result, the detecting of the on-off state of the second thyristor 32 is compensated in spite of temperature change.

Figure 5:
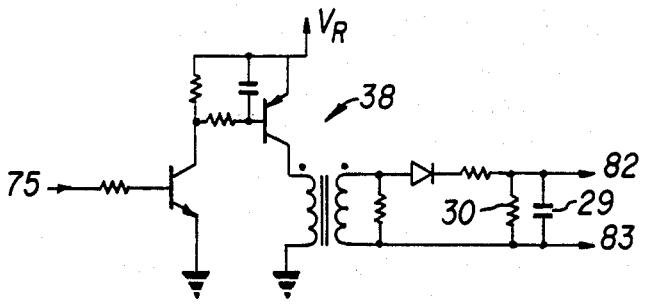
FIG. 5 shows the details of first drive circuit disclosed in FIG. 1.

FIG. 5 shows the first driving circuit 38' in detail, the first driving circuit 38' is formed with a conventional pulse transformer. The first driving circuit 38' receives the trigger signal $V_{75}$ and generates a trigger $V_{82}$ for driving the first thyristor 32 between junctions 82 and 83.

Figure 6:
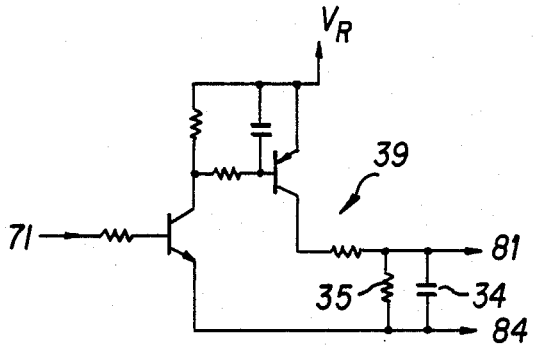
FIG. 6 sets forth the details of second drive circuit disclosed in FIG. 1.

FIG. 6 shows the second driving circuit 39 in detail, the second driving circuit 39 receives the trigger signal $V_{71}$ and generates a trigger signal $V_{81}$ for driving the second thyristor 32 between the junction 81 and the grounded junction 84.

Figures 7A, 7B, 7C, 7D, 7E, 7F, 7G, 7H:
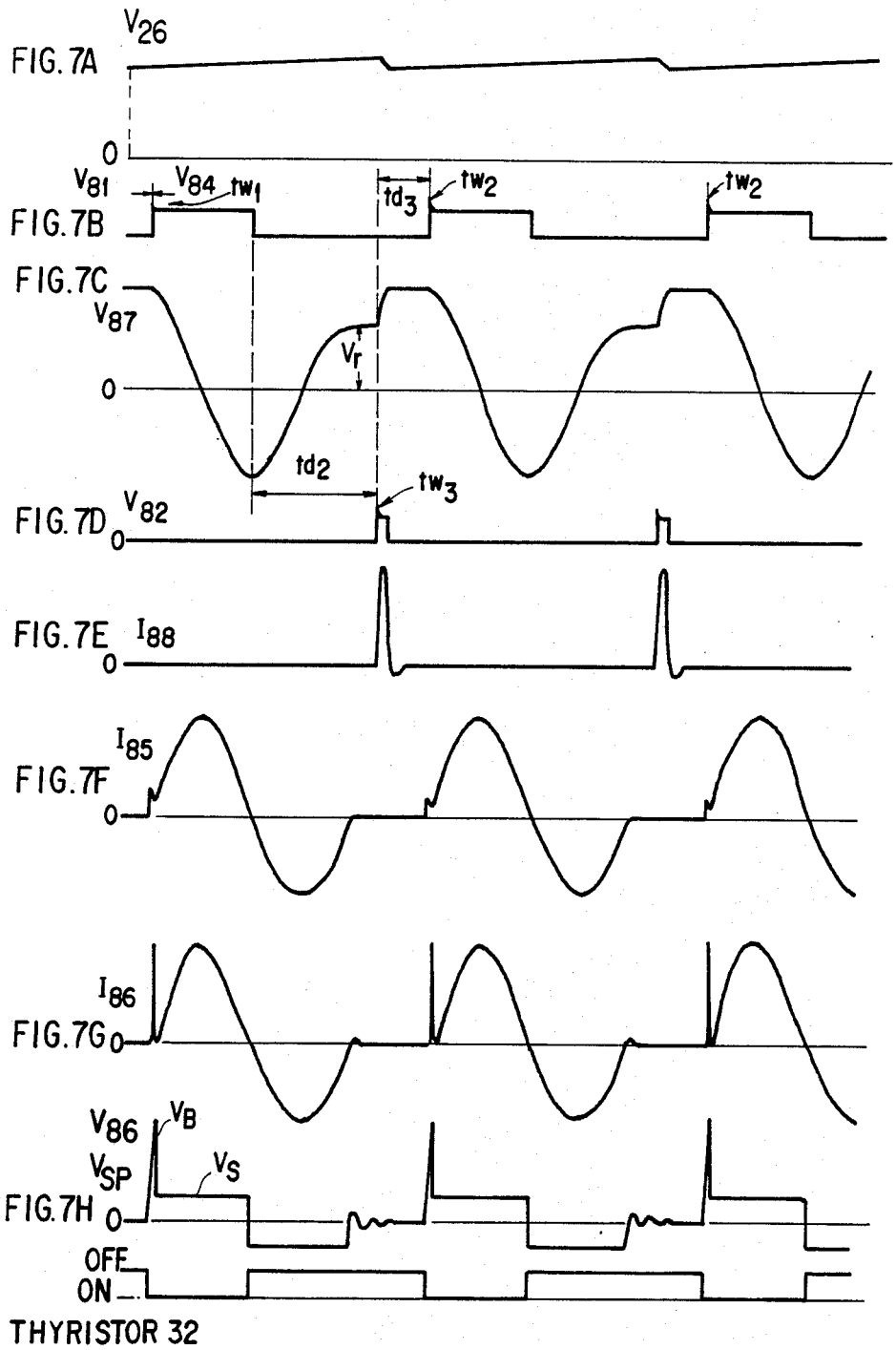
FIGS. 7A–7H are a series of curves showing the voltage and current characteristics at various selected places throughout the circuitry of FIG. 1.

As shown in FIG. 7 when the trigger signal $V_{81}$ is applied between junctions 81 and 84, the second thyristor 32 is turned on whereby the gate voltage $V_{81}$ of second thyristor 32 changes as shown in FIGURE 7B.

Consequently, the current $I_{85}$ for charging a stray capacitor 186, defined by windings 12 and 13 and the spark plug 14 flows at output 85 from the ignition capacitor 15. As the result, the stray capacitor 186 is charged and the voltage $V_{86}$ at output 86 increases and reaches the breakdown voltage $V_B$ in the gap of spark plug 14 as shown in FIG. 7H. The breakdown in gap of spark plug 14, is such that the electric charge of the stray capacitor 186 is discharged quickly and is reflected as a current between gap of spark plug 14 shown in FIG. 7G. After the breakdown in the gap of spark plug 14, as shown in FIGS. 7G–7H, the voltage $V_{86}$ drops to the sustaining voltage $V_s$ (1–3 kv), and the spark current $I_{86}$ flows between the gap of spark plug 14 with the resonant frequency defined by the capacitance of the ignition capacitor 15 and the inductance of the choke coil 31. When the spark current $I_{86}$ becomes zero, the voltage $V_{87}$ at junction 87 is at its maximum negative value, as shown in FIG. 7C. Until now the second thyristor 32 has been turned on, but it is turned off by the voltage $V_{87}$ which provides an inverse bias to the second thyristor 32. Instead of the second thyristor 32 being turned off, the diode 33 is now turned on, and as a result the spark current $I_{86}$ flows in the reverse direction. This spark current $I_{86}$ also has the resonant frequency noted above and charges the ignition capacitor 15. The residual voltage Vr remains at the ignition capacitor 15, which waveform in voltage $V_{87}$ being shown in FIG. 7C.

Subsequently, the trigger $V_{82}$ is supplied to the first thyristor 28 with delay time td2 after the second thyristor 32 is turned off, and the first thyristor 28 is turned on whereby a charge current $I_{88}$ flows at the output 88, as shown in FIG. 7E. The charge current $I_{88}$ is the resonance current, defined by capacitance of the capacitor 15 and inductance of the first inductor 27. As a result of this resonance current, the ignition capacitor 15 is charged and awaits the next occurring discharging by the trigger signal $V_{81}$. When tne charge current $I_{88}$ becomes zero, the voltage $V_{87}$ of ignition capacitor 15 is higher than the voltage $V_{26}$ of first capacitor 24, whereby the first thyristor 28 becomes reverse biased. The instant that the reverse current flows, the first thyristor 28 is to be turned off.

Figure 8:
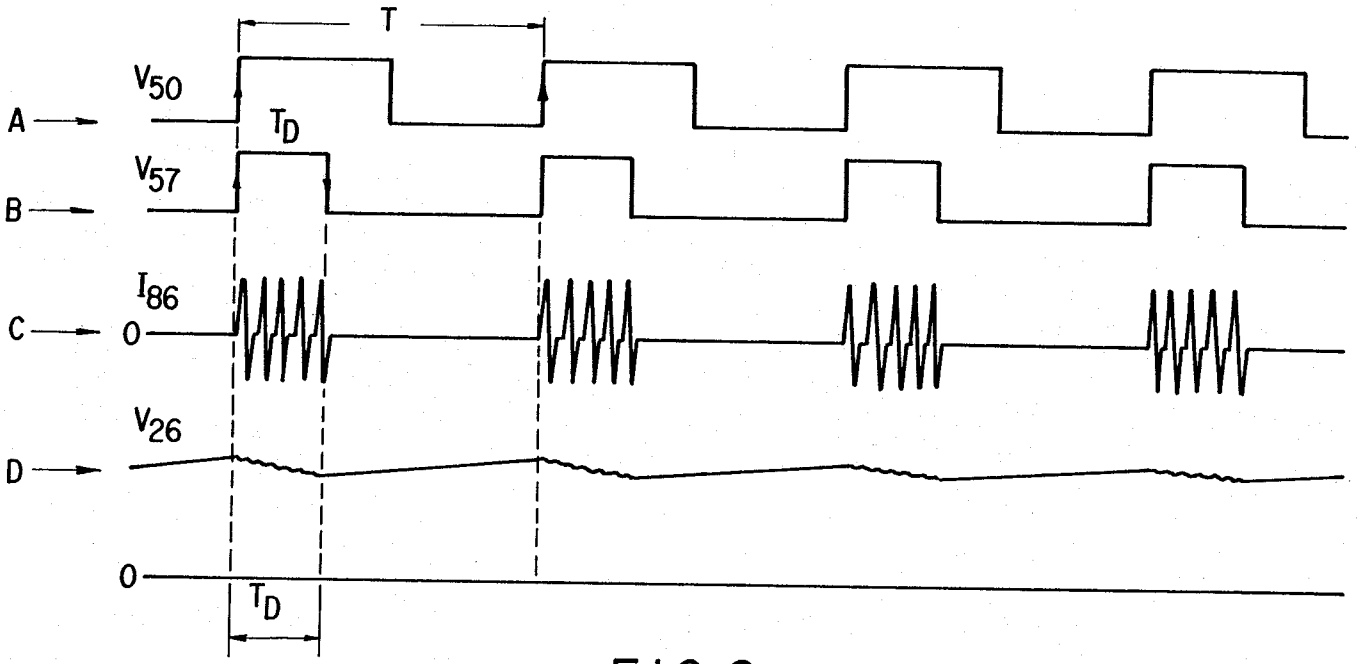
FIGS. 8A–8D are a series of curves showing the voltage and current characteristics at various selected places throughout the circuitry of FIG. 1.

FIG. 8 shows the time relation among the signal $V_{50}$ of breaker point 21, the firing duration signal $V_{57}$, the spark current $I_{86}$ and the voltage $V_{26}$ at the capacitor 24. The voltage $V_{26}$ slightly decrease: during the firing duration, but the voltage $V_{26}$ recovers to the predetermined value during the nonfiring duration. Therefore, the average output lower of the DC-DC voltage converter 10 is decided by the spark duty Ds indicates as follows:

$$Ds = \frac{TD}{T}$$

where

T: the period in the signal $V_{50}$ of breaker point 21

TD: the firing duration

Ds is 0.1 to 0.15 for a typical application.

Therefore, the output power of the DC-DC voltage converter 10 is not required to be high.

Figure 9:
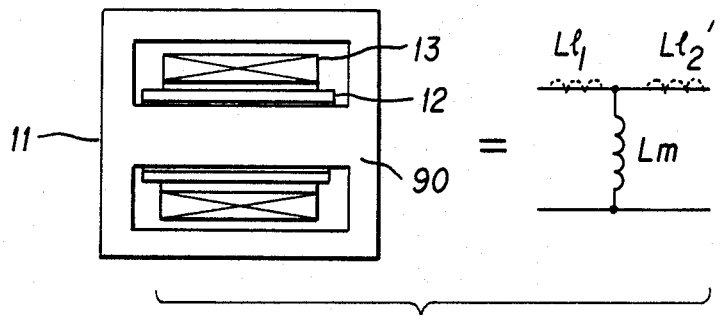
FIG. 9 sets forth the details of ignition transformer disclosed in FIG. 1.

FIG. 9 shows the ignition transformer 11 in detail. The ignition transformer 11 is a low leakage inductance transformer which has no air gap beween the opposed surface of a core 90 at the center of the core 90. Although ignition transformer 11 has low leakage induction, the combination of the transformer 11 with tne choke coil 31 provides a proper spark duration for one shot and a proper spark current $I_{86}$ so that the inductance of the choke coil 31 is selected to be a suitable value with respect to the capacitance of the ignition capacitor 15. It is also to be noted that the sectional area of the core 90 is reduced because the voltage across the primary winding 12 is sufficient low ring the sustaining voltage period of the spark plug wnen compared with conventional air gap ignition transformer operation.

Furthermore, the sectional area of the core 90 is inversely proportional to the resonant frequency of the spark current $I_{86}$ defined by the capacitance of the ignition capacitor 15 and the inductance of the choke coil 31. Thus, the size of the ignition transformer 11 can be decreased in response to an increase in the resonant frequency.

Figure 10:
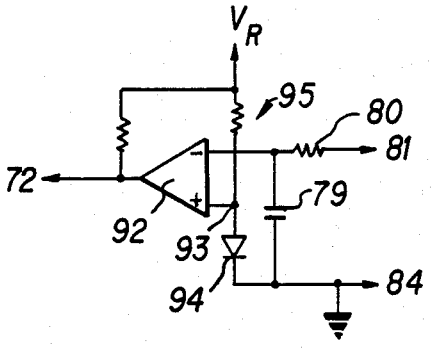
FIG. 10 is another embodiment of detecting circuit disclosed in FIG. 1.

FIG. 10 shows another embodiment of the detecting circuit 37 for detecting the on-off state of second thyristor 32. In this embodiment, the transistor 78 is replaced with a comparator 92 having an inverting input connected to the junction 81 as shown in FIG. 1 and a non-inverting input connected to a junction 93. A voltage $V_{93}$ caused at the junction 93 is the divisional voltage being defined by a diode 94 and a register 95. The voltage $V_{93}$ is set to the predetermined value which is lower than that of the gate voltage $V_{81}$ when the second thyristor 32 is turned on and is higher than that of the voltage $V_{81}$ when the second thyristor 32 is turned off. Furthermore, the temperature coefficient in the P-N (anode-cathode) junction of diode 94 is equal to that of the P-N (anode-cathode) junction in the second thyristor 32. Therefore the detecting circuit 37 in FIG. 10 has the temperature compensation function similar to that of FIG. 1. Consequently the output of the comparator 92 is equal to the voltage $V_{72}$ as shown in FIG. 4.

Figure 11:
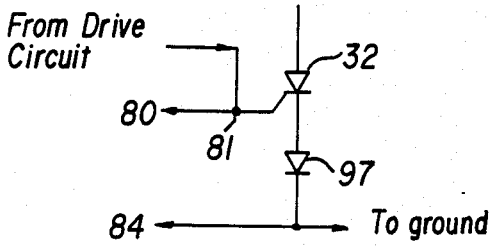
FIG. 11 sets forth a modified embodiment of interconnection among the drive circuit, second thyristor and detecting circuit.
Figure 12:
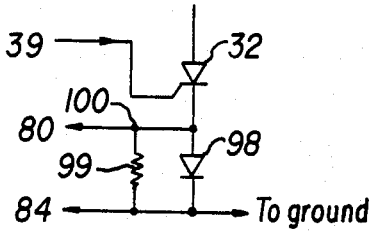
FIG. 12 sets forth a modification of the FIG. 11 embodiment.

The arrangement of FIGS. 11 and 12 provides for the detecting of on-off state of the second thyristor In the arrangement of FIG. 11, a diode 97 is installed between the cathode of second thyristor 32 and the grounded junction 84. The junction 81 at the gate end of thyristor 32 is connected to the resistor 80 of the detecting circuit 37 in FIG. 1 or FIG. 10.

In the arrangement as shown in FIG. 12, a diode 98 and a resistor 99 is installed in parallel between the cathode of second thyristor 32 and the grounded junction 84. The gate of second thyristor 32 ls connected to the output of second driving circuit 39 in FIG. 1 and the junction 100 in FIG. 12 is connected to the resistor 80 in the detecting circuit 37 in FIG. 1 or FIG. 10.

Figure 13:
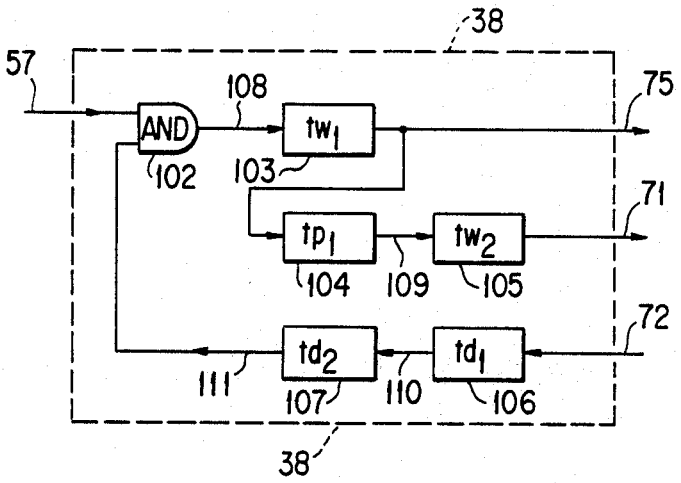
FIG. 13 sets forth a modification of repetition rate control circuit disclosed in FIG. 1.

FIG. 13 shows another embodiment of the repetition rate control circuit 38. In this embodiment of circuit 38 the trigger $V_{75}$ for operating the first thyristor 28 is first generated when the repetition rate control circuit 38 receives the firing duration signal $V_{57}$ (the repetition rate control circuit 38 in FIG. 1 first generates the trigger $V_{71}$ for operating the second thyristor 32 when the circuit 38 receives the firing duration signal $V_{57}$).

The repetition rate control circuit 38 in FIG. 13 includes an AND circuit 102, a one-shot multivibrator 103, a monostable multivibrator 104, a one-shot multivibrator 105 and delay circuits 106 and 107. The connection between the circuits 102, 103, 104, 105, 106, 107 and the points 57, 71, 72 and 75 is as shown in FIG. 13.

The AND circuit 102 receives the firing duration signal $V_{57}$. The one-shot multivibrator 103 detects the rising edge of voltage $V_{108}$, which is the output of AND circuit 102, and generates the tigger $V_{75}$ for operating the first thyristor 28 as shown in FIG. 14C. The monostable multivibrator 104 detects the rising edge of the trigger $V_{75}$ and generates a signal $V_{109}$ at output 109 during the time tp1 of the time constant thereof.

The one-shot multivibrator 105 detects the falling edge of the signal $V_{109}$ and generates the trigger $V_{71}$ for operating the second thyristor 32.

The delay circuit 106 detects the falling edge of signal $V_{72}$ corresponding to the on-off state of second thyristor 32 (the high level voltage of signal $V_{72}$ indicates the off state of second thyristor 32) and generates a signal $V_{110}$ at point 110 with delay time td1. The delay circuit 107 detects the rising edge of signal $V_{110}$ and generates a signal $V_{111}$ at place 111 with delay time td2. The signal $V_{111}$ is supplied to the AND circuit 102.

The relation between each shape in the signals output in FIG. 13 and their timing is shown in FIGURES 14A–14H.

The discharging circuit 37 can take the form of dfferent configurations depending upon the desired shape of spark current $I_{86}$.

Figure 15:
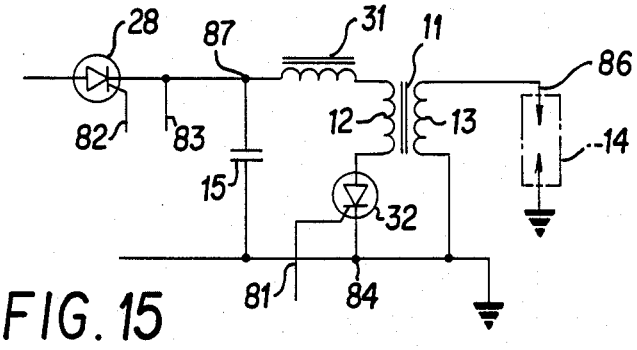
FIG. 15 sets forth a first modification of discharge circuit disclosed in FIG. 1.

If a spark current $I_{86}$ is desired to be a half sine wave as shown in FIG. 16F, the circuit disclosed in FIG. 15 is utilized as the discharge circuit. The dscharge circuit in FIG. 15 deletes the diode 33 dsclosed in FIG. 1 whereby the reverse current does not flow through the ignition transformer 11, and the spark current $I_{86}$ becomes a half sine wave. Other voltages $V_{81}$, $V_{87}$, $V_{82}$ and $V_{86}$ currents $I_{88}$, $I_{85}$ and $I_{86}$ caused at places 81, 87, 82, 88, 85 and 86 and their timing are as shown in FIGS. 16A–16G.

Figure 17:
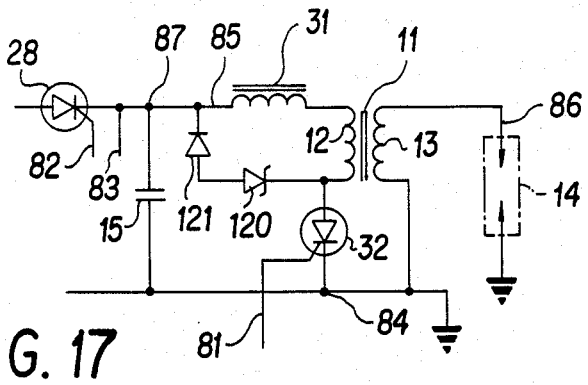
FIG. 17 is similar to FIG. 15 and sets forth a second modification thereof.
Figure 19:
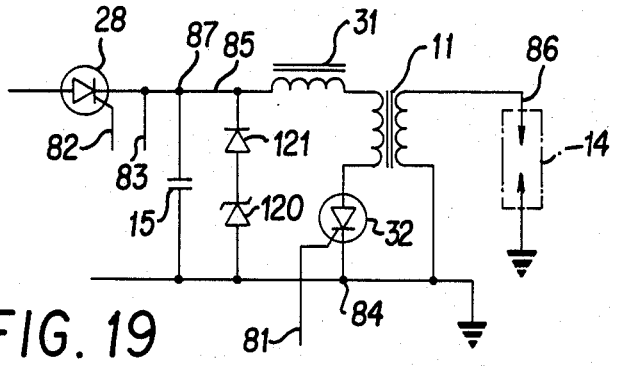
FIG. 19 is similar to FIG. 15 and sets forth a third modification thereof.

Furthermore, if a spark current $I_{86}$ is a saw tooth wave as shown in FIGS. 18G and 20F, the circuits disclosed in FIGS. 17 and 19 are utilized as discharge circuits. In FIG. 17, a Zener diode 120 and a diode 121 is installed between the ignition capacitor 15 and the anode of second thyristor 32 and the diode 33 disclosed in FIG. 1 is deleted.

In FIG. 19, the Zener diode 120 and the diode 121 in FIG. 17 are installed between the junctions 87 and 84. FIGS. 18A–18H and 20A–20G show the voltages $V_{81}$, $V_{87}$, $V_{82}$, $V_{86}$ with the currents $I_{88}$, $I_{85}$ and $I_{86}$ at places 81, 87, 82, 88, 85 and 86 indicated as in FIGS. 17 and 19.

The current Ia, as shown in FIG. 18F, represents the current flowing through the Zener diode 120 and diode 121 in FIG. 17.

As shown in FIGS. 7C and 16B, the residual voltage Vr remains at the junction 87 connected to the ignition capacitor 15 disclosed in FIGS. 1 and 15 prior to recharging of the ignition capacitor 15. In the discharge circuit 37 in FIG. 1, the residual voltage Vr is positive. In turn, in the discharge circuit 37 in FIG. 15, the residual voltage Vr is negative.

Figure 23:
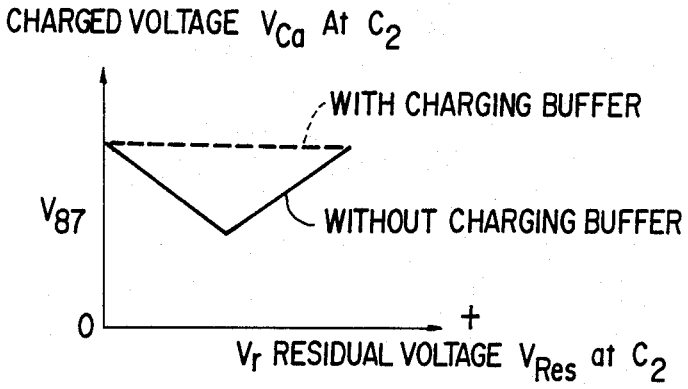
FIG. 23 sets forth the function of the buffer disclosed in FIG. 21.
Figure 26:
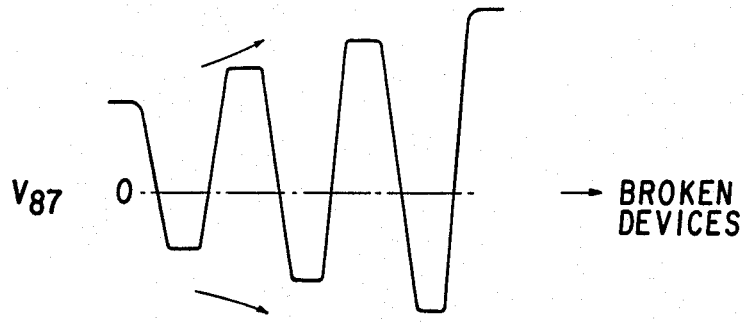
FIG. 26 sets forth a voltage characteristic of the ignition capacitor disclosed in FIG. 15.
Figure 27:
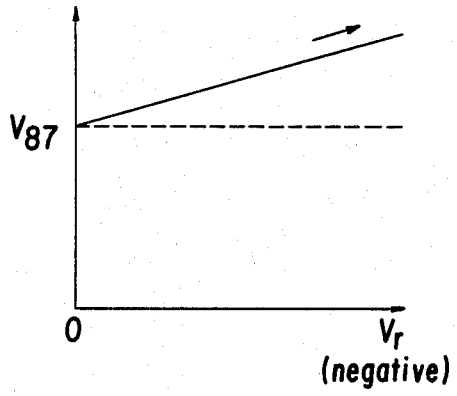
FIG. 27 sets forth the function of the buffer disclosed in FIG. 24.

These residual voltages Vr are undesirable because the charged voltage in the ignition capacitor 15 in next charging changes in response to the residual voltage Vr. For example, the charged voltage $V_{87}$ in the ignition capacitor 15 in FIG. 1 changes according to residual voltage Vr as shown in the solid line in FIG. 23, and, in turn, the charged voltage $V_{87}$ in the ignition capacitor 15 in FIG. 15 changes according to residual voltage Vr as shown in the solid line in FIG. 27. As the result for negative residual voltage, as the situation repeats itself, there is no limit to the increase in the charged voltage $V_{87}$ as shown in FIG. 26.

Therefore, if either a positive or negative residual voltage Vr appears, the combustion stabilization of the engine is not accomplished or one of the elements such as the second thyristor 32 of the discharge switch becomes damaged.

But, in the discharge circuit in FIGS. 17 and 19, the residual voltage is negligible as shown in FIGS. 18B and 20B.

In order to remove the influence of the residual voltage Vr and to regulate the charged voltage $V_{87}$ during charging time, a buffer circuit is connected to the charging circuit 16.

Figure 21:
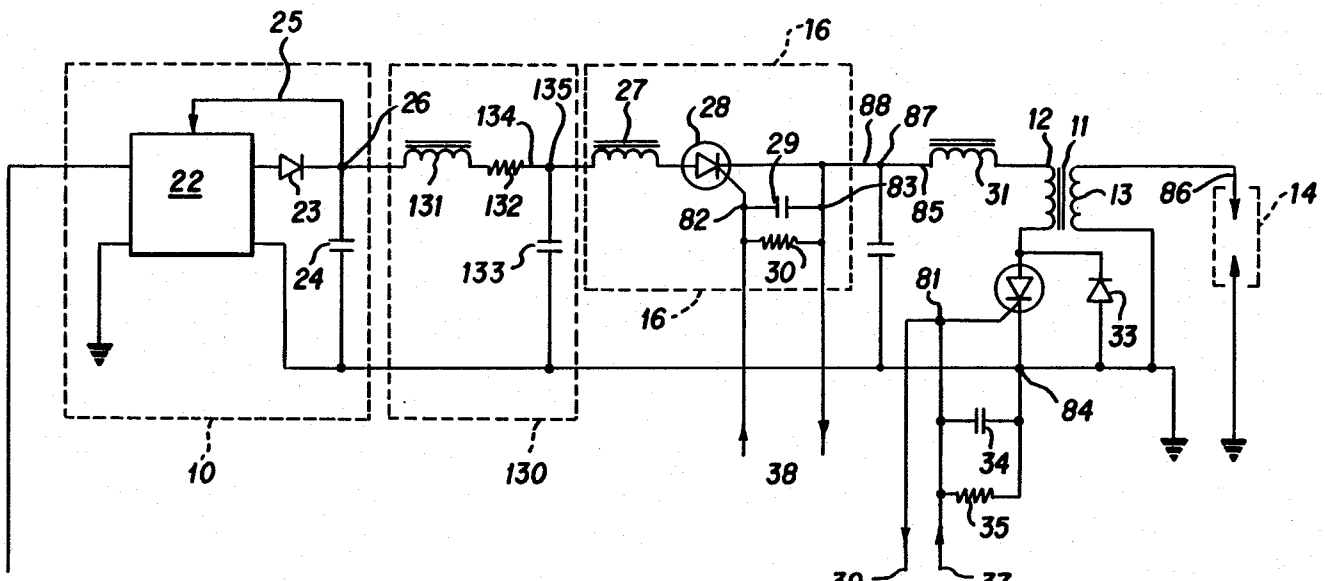
FIG. 21 sets forth a first embodiment of a buffer as well as their interconnections.

A buffer 130, as shown in FIG. 21, is available against the positive residual voltage Vr. The buffer 130 includes a second inductor 131 (200 μH) and a resistor 132 and a second capacitor 133 (2~3 μF) which is two to three times greater than capacitor 15 (1 μF) and is electrically connected to the DC-DC voltage converter 10, the charging circuit 16 and the ignition capacitor 15 as shown in FIG. 21.

Current $I_{134}$ which is output at 134 and a voltage $V_{135}$ at the junction 135 in FIG. 21 is as shown in FIG. 22F–22G. By the operation of this current $I_{134}$ and voltage $V_{135}$, the charged voltage $V_{87}$ of the ignition capacitor 15, during charging, is constant and does not have residual voltage influence which is shown as a chained line in FIG. 23.

Figure 24:
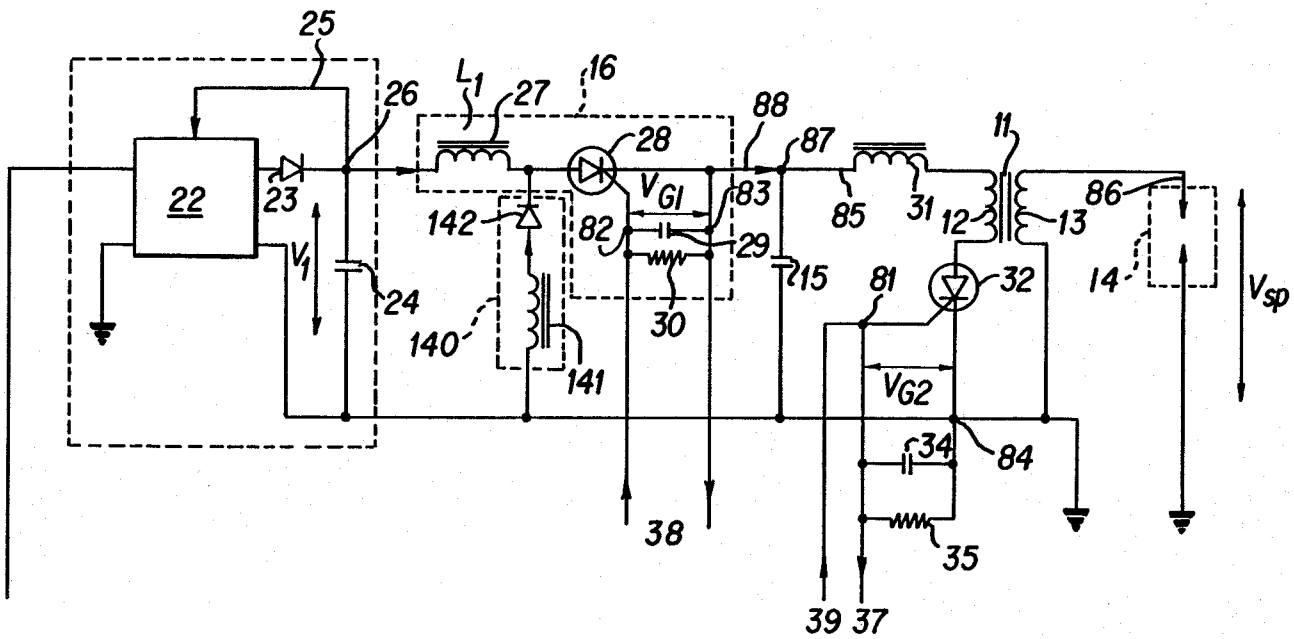
FIG. 24 sets forth a second embodiment of buffer as well as their interconnections.
Figures 25A, 25B, 25C, 25D, 25E, 25F, 25G, 25H:
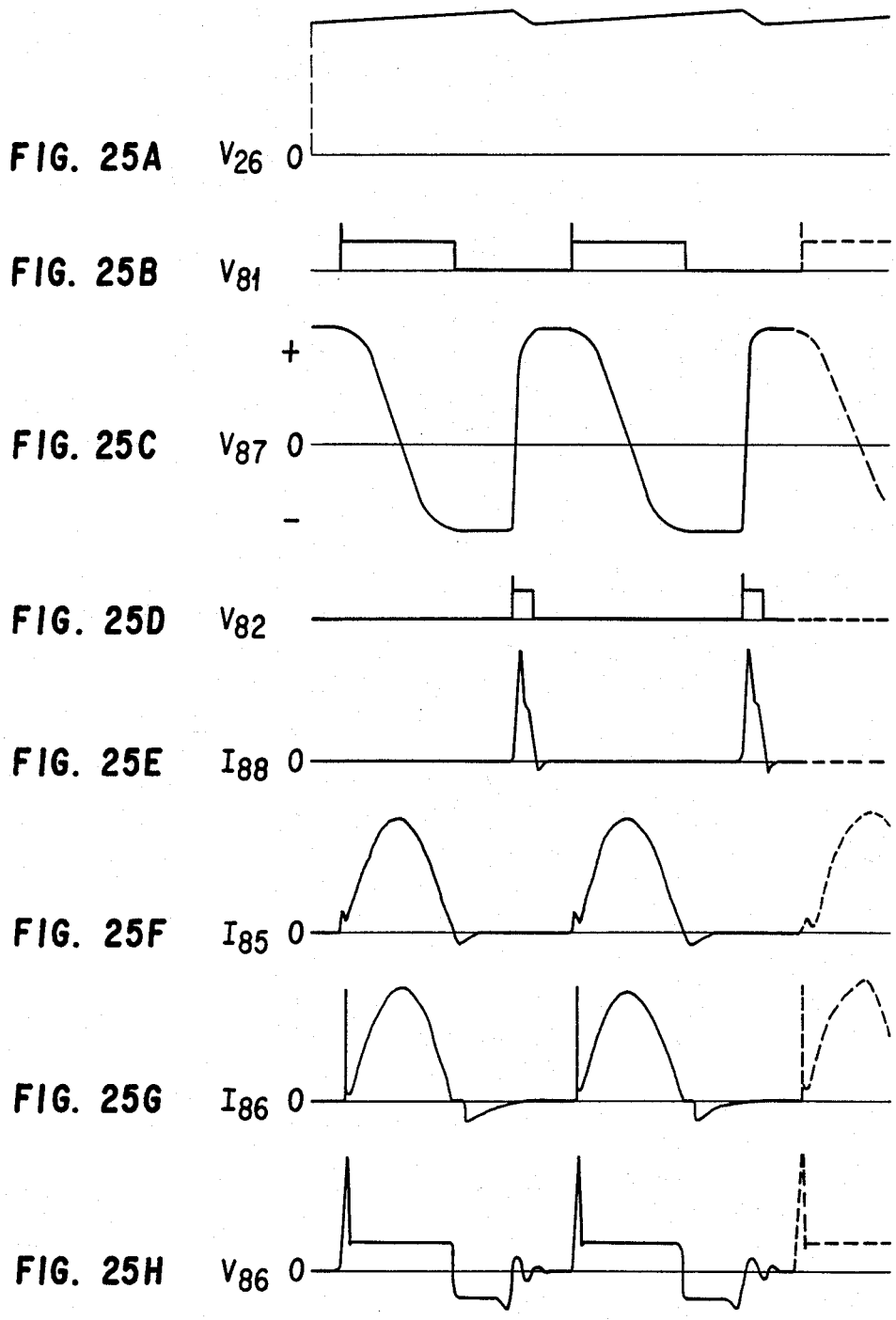
FIGS. 25A–25H are a series of curves showing the voltage and current characteristics at various selected places throughout the circuitry of FIG. 24.

A buffer 140 as shown in FIG. 24, is available against a negative residual voltage Vr. The buffer 140 includes a third inductor 141 (25 μH) and a diode 142 and is eletrically connected to the charging circuit 16 as shown in FIG. 24. By the operation of the buffer 140, when the first thyristor 28 is turned on, the negative residual voltage at ignition capacitor 15 is passed through the second inductor 141 and the diode 142. As the result, the current $I_{88}$ flowing through the portion 88 in FIG. 24 is the total of a current $I_{143}$ flowing through the second inductor 141 and a current $I_{144}$ flowing through the first inductor 27. The resonant frequency produced by the inductor 141 and the capacitor 15 is of a high value so that the inductance value of the inductor 141 is selected to be smaller than the inductance value of the inductor 27 (200 micro H).

Thus, the buffer 140 charges the capacitor 15 faster than the inductor 27. In actuality, the buffer circuit 140 acts by reversing the polarity of the capacitor 15. Consequently, the negative residual voltage $V_r$ is reduced to a negligible value when the charging current $I_{144}$ from the inductor 27 approximately reaches its peak value. Thus, the charged voltage $V_{87}$ of ignition capacitor 15 is constant and does not have the negative residual voltage influence which is shown as a chained line in FIG. 27.

Figure 28:
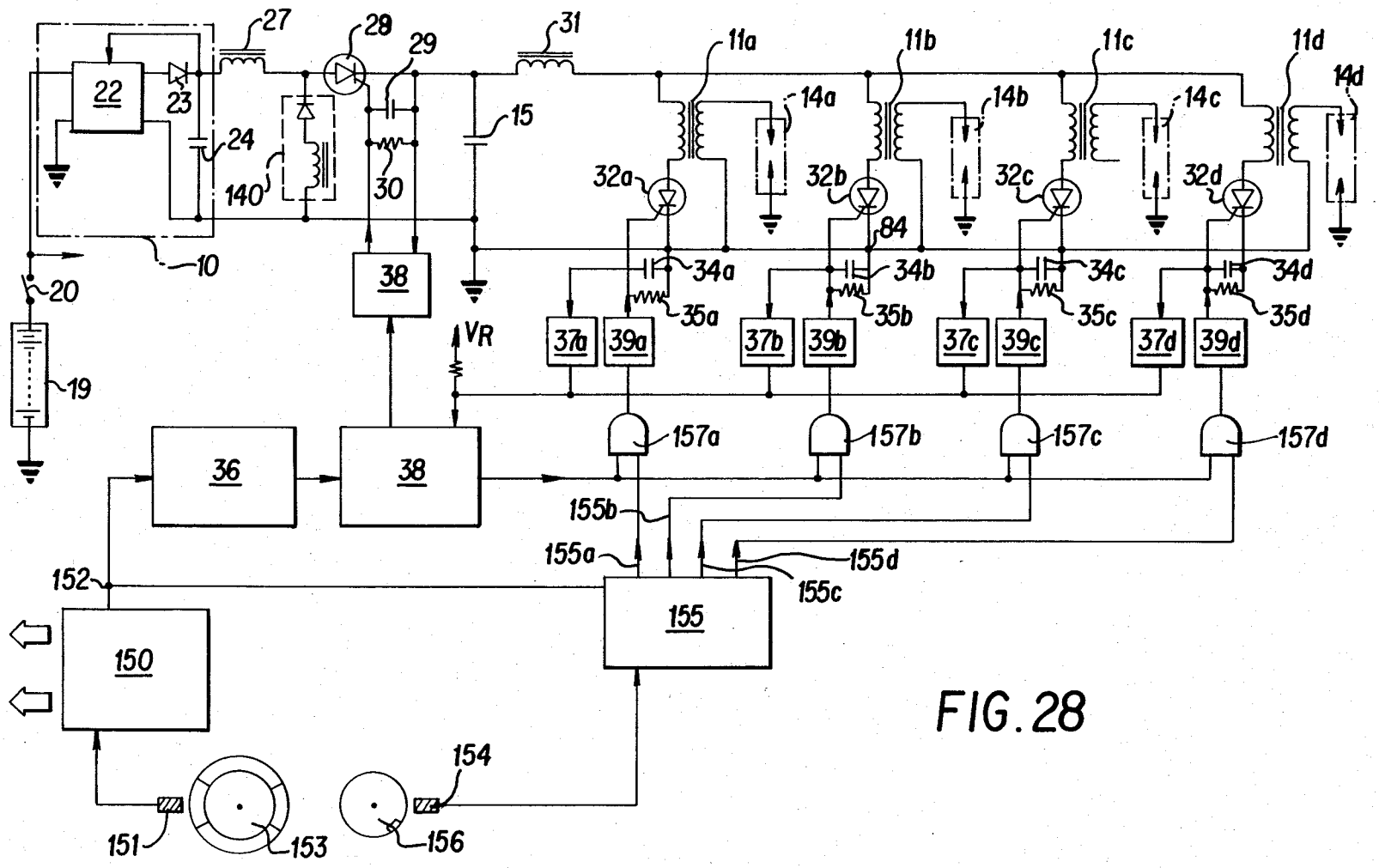
FIG. 28 is a circuit diagram showing the operation circuit elements as well as their interconnections in a non-mechanical distributor ignition system of four cylinder engine.

FIG. 28 shows a preferred embodiment of a nonmechanical distributor ignition system in a four cylinder engine applied to the present invention.

Figure 29:
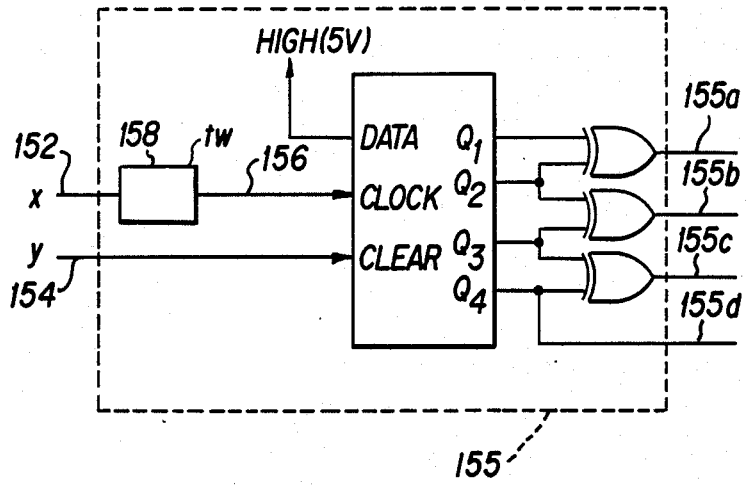
FIG. 29 sets forth the details of cylinder selecting circuit 155 disclosed in FIG. 28.
Figure 30:
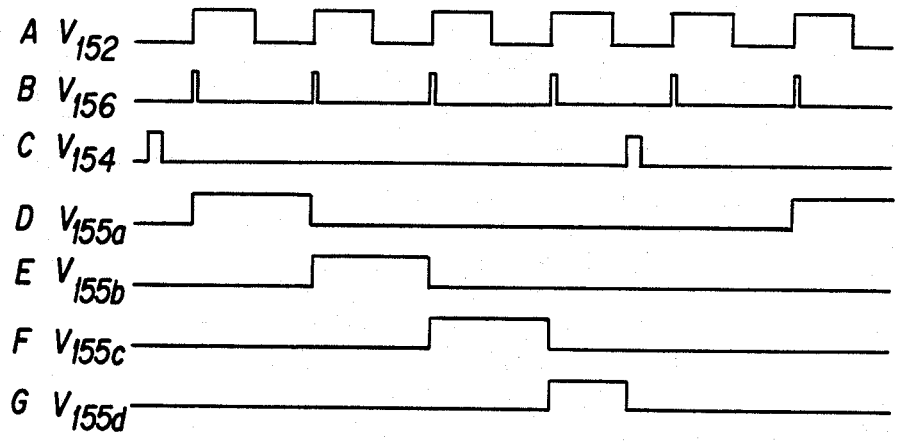
FIGS. 30A–30G are a series of curves showing the voltage characteristics at various selected places throughout the circuitry of FIG. 29.

In this system, the spark current is in the shape of a half sine wave and the buffer 140 noted above is utilized. Each ignition transformer **11*a*, 11*b*, 11*c* and 11*d* is arranged respectively with each spark plug 14*a*, 14*b*, 14*c* and 14*d*. Each second thyristor 32*a*, 32*b*, 32*c* and 32*d*, and each drive circuit 39*a*, 39*b*, 39*c* and 39*d* for driving each thyristor 32*a*, 32*b*, 32*c* and 32*d* is arranged respectively with ignition transformer 11*a*–11*d*. The detecting circuits 37*a*, 37*b*, 37*c*, and 37*d* for detecting on-off state of each thyristor 32*a*, 32*b*, 32*c* and 32*d* are arranged respectively with thyristor 32*a*, 32*b*, 32*c* and 32*d*. The ignition trnsformers 11*a*, 11*b*, 11*c* and 11*d* are electrically connected to the ignition capacitor 15 via the choke coil 31. A engine computer 150 generates a signal $V_{152}$ at the output 152 in FIG. 28 which is based on the output of a crank angle sensor 151 for detecting the degree of rotation of crankshaft 153 in the engine. The signal $V_{152}$ is similar to the signal $V_{50}$ generated by the breaker point 21. A cam angle sensor 154 detects the angle of the cam shaft 156, which is a source signal to select the one of four spark plugs for firing, and which generates a signal $V_{154}$ as an output as shown in FIG. 30C. The signal $V_{152}$ is applied to the firing duration decision circuit 36 and a cylinder selecting circuit 155. Also the signal $V_{154}$ is applied to the cylinder selecting circuit 155. The cylinder selecting circuit 155 is formed with a four stage static shift register as shown in FIG. 29. Each output 155*a*, 155*b*, 155*c* and 155*d* in FIG. 29 has associated therewith the voltages $V_{155a}$, $V_{155b}$, $V_{155c}$ and $V_{156d}$, respectively, as shown in FIGS. 29D–29G. Each voltage $V_{155a}$, $V_{155b}$, $V_{155c}$ and $V_{155d}$ is applied to each driving circuit 39*a*, 39*b*, 39*c* and 39*d* via each AND circuit 157*a*, 157*b*, 157*c* and 157*d*. Each AND circuit 157*a*, 157*b*, 157*c* and 157*d* receives the trigger $V_{71}$ for operating the thyristors 32*a*, 32*b*, 32*c* and 32*d* from the repetition rate circuit 38. The reference numeral 158 in FIG. 29** indicates a one-shot multivibrator detecting the rising edge of the signal $V_{152}$.

Consequently, the selecting spark plug by the signal $V_{155a}$, $V_{155b}$, $V_{155c}$ and $V_{155d}$ produces an ignition spark train in proper timed sequence during the demanded firing duration.

In the drawings, the reference symbols Vc and $V_B$ indicate a regulated DC voltage of 5 volts and the DC voltage of battery 19 of 12 volts.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent in the United States is:

1. An automotic ignition system comprising:

a spark plug means;

ignition transformer means having a primary winding and a second winding said second winding being connected to said spark plug means;

a DC-DC voltage conveter means having a first capacitor for storing a regulated voltage;

a ignition capacitor means electrically connected to said prmary winding of said ignition transformer means for providing energy to said spark plug means;

charging means means for charging said ignition capacitor means from said first capacitor;

discharge means for discharging said ignition capacitor means to said primary winding of said ignition transformer means;

control means for operating said charging means and said discharging means in proper timed sequence during a demanded firing duration; and said control means having a detecting means for detecting the on-off state of said discharging means.

2. An automotive ignition system according to claim 1, wherein said control means includes means for generating a first signal indicting said demanded firing duration in response to a rotational speed of an engine.

3. An automotive ignition system according to claim 1, wherein said ignition transformer means has a low leakage inductance and electrically connected to said ignition capacitor means through a choke coil at said primary winding thereof.

4. An automotive ignition system according to claim 3, wherein said ignition transformer has no air gap between the opposed surfaces of a core installed therein.

5. An automotive ignition system comprising:

a spark plug means;

ignition transformer means having a primary winding and a secondary winding, said secondary winding being connected to said spark plug means;

a DC-DC voltage conveter means having a first capacitor for storing a regulated voltage;

a ignition capacitor means electrically connected to said primary winding of said ignition transformer means for providing energy to said spark plug means;

charge means means for charging said ignition capacitor means from said first capacitor;

discharge means for discharging said ignition capacitor means to said primary winding of said ignition transformer means, said discharge means being formed with a first thyristor;

control means for operating said charge means and said discharge means in proper timed sequence during a demanded firing duration; and said control means having a detecting means for detecting the on-off state of said first thyristor.

6. An automotive ignition system according to claim 5, wherein said detecting means further includes temperature compensating means.

7. An automotive ignition system according to claim 5, wherein said detecting means detects the voltage at a gate of said first thyristor.

8. An automotive ignition system according to claim 5, wherein said detecting means has a first diode electrically connected between a cathode of said first thyristor and ground, and wherein said detecting means detects the voltage at said first diode.

9. An automotive ignition system according to claim 6, wherein said temperature compensative means comprises a transistor having a P-N junction whose temperature coefficient is equal to the temperature coefficient of the P-N junction of said first thyristor.

10. An automotive ignition system according to claim 6, wherein said temperature compensative means comprises a diode having a P-N junction whose temperature coefficient is equal to the temperature coefficient of the P-N junction of the first thyristor.

11. An automotive ignition system comprising:

a spark plug means;

ignition transformer means having a primary winding and a secondary winding, said secondary winding being connected to said spark plug means;

a DC-DC voltage converter means having a first capacitor for storing a regulated voltage;

a ignition capacitor means electrically connected to said primary winding of said ignition transformer mens for providing energy to said spark plug means;

charging means for charging said ignition capacitor means by said first capacitor;

discharging means for discharging said ignition capacitor means to said primary winding of said ignition transform means; and control means for operating said charging means and said discharging means in proper timed sequence during a demanded firing duration, said control means including means for generating a first signal indicating said demanded firing duration in response to the rotational speed of an engine, said means for generating said first signal indicating said demanded firing duration including detecting means for detecting a pulse signal indicating the starting time of said demanded firing duration and changing said pulse signal in response to the speed of said engine, memory means for memorizing a second signal in response to said pulse signal, comparator means for comparing the output of said memory means and an output of said detecting means and generating said first signal, and replacing means for replacing said output of said memory means with said output of said detecting means after generating said first signal until a subsequent pulse signal occurs.

12. An automotive ignition system according to claim 11, wherein said pulse signal is generated at a breaker point.

13. An automotive system according to claim 11, wherein said pulse signal is proportional to an output of a crank angle sensor.

14. An automotive ignition system according to claim 11, wherein said memory means comprises a second capacitor.

15. An automotive ignition system according to claim 11, wherein said output of said detecting means is fed to a second capacitor.

16. An automotive ignition system comprising:

a spark pug means;

ignition transformer means having a primary winding and a secondary winding, said secondary winding being connected to said spark plug means;

a DC-DC voltage converter means having a first capacitopr for storing a regulated voltage;

a ignition capacitor means electrically connected to said primary winding of said ignition transmformer means for providing energy to said spark plug means;

charging means including a first inductor and a first thyristor and for charging said ignition capacitor means from said first capacitor;

discharging means for discharging said ignition capacitor means to said primary winding of said ignition transformer means;

control means for operating said charging means and said discharging means in proper timed sequence during a demanded firing duration; and said charging means further including a charge circuit which including a second capacitor for limiting a charge current flowing into said ignition capacitor means through said first inductor and said first thyristor and preventing said ignition capacitor means from over charging and means for limiting a charge current flowing into said second capacitor from said first capacitor, so as to regulate a charged voltage at said ignition capacitor means in no connection with a residual voltage at said ignition capacitor means.

17. An automotive ignition system according to claim 16, wherein said means for limiting a charge current flowing into said second capacitor from said first capacitor includes a second inductor.

18. An automotive ignition system according to claim 16, wherein said second capacitor has a capacity which is larger than that of said ignition capacitor means and smaller than that of said first capacitor.

19. An automotive ignition system comprising:

a spark plug means;

ignition transformer means having a primary winding and a secondary winding, said secondary winding being connected to said spark plug means;

a OC-DC voltage converter means having a first capacitor for storing a regulated voltage;

a ignition capacitor means electrically connected to said primary winding of said ignition transformer means for providing energy to said spark plug means;

charging means including a first inductor and a first thyistor and for charging said ignition capacitor means from said first capacitor;

discharging means for discharging said ignition capacitor means to said primary winding of said ignition transformer means;

control means for operating said charging means and said discharging means in proper timed sequence during a demanded firing duration; and said charging means further including a charging circuit for inverting a negative residual voltage at said ignition capacitor means through said first thyristor before charging said ignition capacitor means from said first capacitor through said first inductor at the moment when said first thyristor turned on so as to regulate a charged voltage at said ignition capacitor means in no connection with said negative residual voltage at said ignition capacitor means.

20. An automotive ignition system according to claim 19, wherein said charge circuit includes a second inductor.

21. An automotive ignition system according to claim 20, wherein said second inductor has an inductance which is smaller than that of said first inductor.

* * * * *

UNITED STATES PATENT AND TRADEMARK OFFICE

CERTIFICATE OF CORRECTION

PATENT NO. : 4,733,646

DATED : MARCH 29, 1988

INVENTOR(S) : SHIMICHIRO IWASAKI

It is certified that error appears in the above-identified patent and that said Letters Patent is hereby corrected as shown below:

In the abstract, line 3, delete "a" (first occurrence) and insert therefor --an--.

Column 1, line 7, delete "multistrike" and insert therefor --multi-strike--.

Column 1, line 16, delete "a" (first occurrence) and insert therefor --an--.

Column 1, line 20, delete "a" (first occurrence) and insert therefor --an--.

Column 1, line 21, delete "iischarge" and insert therefor --discharge--.

Column 1, line 34, delete "lgnition" and insert therefor --ignition--.

Column 1, line 45, delete "to".

Column 2, line 10, delete "a" and insert therefor --an--.

Column 2, line 15, delete "fo" and insert therefor --of--.

Column 2, lines 25-26, delete "Although leakage" and insert therefor --Leakage--.

UNITED STATES PATENT AND TRADEMARK OFFICE

CERTIFICATE OF CORRECTION

DATED : MARCH 29, 1988

INVENTOR(S) : SHIMICHIRO IWASAKI

It is certified that error appears in the above-identified patent and that said Letters Patent is hereby corrected as shown below:

Column 2, line 28, before "primary" insert --the--.

Column 2, line 28, after "current" insert --which--.

Column 2, line 53, delete "systems" and insert therefor --system--.

Column 2, line 63, before "non-mechanical" insert --a--.

Column 2, line 64, delete "systems" and insert therefor --system--.

Column 2, line 68, delete "a" (third occurrence) and insert therefor --an--.

Column 3, line 26, delete "generatling" and insert therefor --generating--.

Column 3, line 56, delete "small size" and insert therefor --small-sized--.

Column 3, line 61, delete "frequeny" and insert therefor --frequency--.

Column 4, line 1, delete "capcitor" and insert therefor --capacitor--.

Column 4, line 1, begin a new line with "And,".

UNITED STATES PATENT AND TRADEMARK OFFICE

CERTIFICATE OF CORRECTION

PATENT NO. : 4,733,646

DATED : MARCH 29, 1988

INVENTOR(S) : SHIMICHIRO IWASAKI

It is certified that error appears in the above-identified patent and that said Letters Patent is hereby corrected as shown below:

Column 4, line 10, delete "capcitor" and insert therefor --capacitor--.

Column 4, line 36, delete "resonance" and insert therefor --resonant--.

Column 6, line 2, delete "a" (second occurrence) and insert therefor --an--.

Column 6, line 5, delete "a" and insert therefor --an--.

Column 6, line 15, delete "a" (first occurrence) and insert therefor --an--.

Column 6, line 36, delete "(mH) and insert therefor --(μH)--.

Column 6, line 46, delete "38'" and insert therefor --38--.

Column 6, line 56, delete "a" (first occurrence) and insert therefor --an--.

UNITED STATES PATENT AND TRADEMARK OFFICE

CERTIFICATE OF CORRECTION

PATENT NO. : 4,733,646

DATED : MARCH 29, 1988

INVENTOR(S) : SHIMICHIRO IWASAKI

It is certified that error appears in the above-identified patent and that said Letters Patent is hereby corrected as shown below:

Column 7, lines 11-12, delete "the high level of signal $V_{50}$ rises" and insert therefor --the signal $V_{50}$ rises to its high level--.

Column 7, line 45, delete "kept" and insert therefor --driven--.

Column 8, line 22, after "during" insert --the time that--.

Column 8, line 22, after "level" insert --,--.

Column 8, line 23, after "by" insert --either--.

Column 8, line 23, delete "and" and insert therefor --or--.

Column 8, line 41, delete "ouput" and insert therefor --output--.

Column 8, line 54, delete "detail, the" and insert therefor --detail. The--.

Column 8, line 60, delete "detail, the" and insert therefor --detail. The--.

UNITED STATES PATENT AND TRADEMARK OFFICE

CERTIFICATE OF CORRECTION

PATENT NO. : 4,733,646

DATED : MARCH 29, 1988

INVENTOR(S) : SHIMICHIRO IWASAKI

It is certified that error appears in the above-identified patent and that said Letters Patent is hereby corrected as shown below:

Column 9, line 38, delete "tne" and insert therefor --the--.

Column 9, line 47, delete "decrease:" and insert therefor --decreases--.

Column 9, line 49, delete "nonfiring" and insert therefor --non-firing--.

Column 9, line 50, delete "lower" and insert therefor --power--.

Column 9, line 51, delete "indicates" and insert therefor --indicated--.

Column 9, line 65, delete "beween" and insert therefor --between--.

Column 9, line 68, delete "tne" and insert therefor --the--.

Column 10, line 7, delete "sufficient" and insert therefor --sufficiently--.

Column 10, line 7, delete "ring" and insert therefor --during--.

UNITED STATES PATENT AND TRADEMARK OFFICE

CERTIFICATE OF CORRECTION

PATENT NO. : 4,733,646

DATED : MARCH 29, 1988

INVENTOR(S) : SHIMICHIRO IWASAKI

It is certified that error appears in the above-identified patent and that said Letters Patent is hereby corrected as shown below:

Column 10, line 8, delete "wnen" and insert therefor --when".

Column 10, line 8, after "with" insert --the--.

Column 10, line 24, delete "register" and insert therefor --resistor--.

Column 10, line 37, after "thyristor " insert -- 32. --.

Column 10, line 45, delete "is" and insert therefor --are--.

Column 10, line 47, delete "1s" and insert therefor --is--.

Column 10, line 68, delete "tigger" and insert therefor --trigger--.

Column 11, line 9, delete "on-off" and insert therefor --off--.

Column 11, line 16, delete "signals" and insert therefor --signal's--.

Column 11, line 19, delete "37" and insert therefor --17--.

UNITED STATES PATENT AND TRADEMARK OFFICE

CERTIFICATE OF CORRECTION

PATENT NO. : 4,733,646

DATED : MARCH 29, 1988

INVENTOR(S) : SHIMICHIRO IWASAKI

It is certified that error appears in the above-identified patent and that said Letters Patent is hereby corrected as shown below:

Column 11, lines 19-20, delete "dfferent" and insert therefor --different--.

Column 11, line 24, delete "dscharge" and insert therefor --discharge--.

Column 11, line 25, delete "dsclosed" and insert therefor --disclosed--.

Column 11, line 29, after "$V_{86}$" insert --and--.

Column 11, line 36, delete "is" and insert therefor --are--.

Column 11, line 51, delete "37" and insert therefor --17--.

Column 12, line 19, delete "is" and insert therefor --are--.

Column 12, line 19, delete "FIG." and insert therefor --FIGS.--.

Column 12, line 28, delete "eletrically" and insert therefor --electrically--.

UNITED STATES PATENT AND TRADEMARK OFFICE

CERTIFICATE OF CORRECTION

PATENT NO. : 4,733,646

DATED : MARCH 29, 1988

INVENTOR(S) : SHIMICHIRO IWASAKI

It is certified that error appears in the above-identified patent and that said Letters Patent is hereby corrected as shown below:

Column 12, lines 51-52, delete "nonmechanical" and insert therefor --non-mechanical--.

Column 12, line 65, delete "trnsformers" and insert therefor --transformers--.

Column 12, line 67, delete "A" and insert therefor --An--.

Column 13, line 5, delete "cam shaft" and insert therefor --camshaft--.

Column 13, line 16, delete "29D-29G" and insert therefor --30D-30G--.

Column 13, line 39, delete "automotic" and insert therefor --automotive--.

Column 13, line 44, delete "conveter" and insert therefor --converter--.

Column 13, line 46, delete "a" and insert therefor --an--.

Column 13, line 47, delete "prmary" and insert therefor --primary--.

UNITED STATES PATENT AND TRADEMARK OFFICE

CERTIFICATE OF CORRECTION

PATENT NO. : 4,733,646

DATED : MARCH 29, 1988

INVENTOR(S) : SHIMICHIRO IWASAKI

It is certified that error appears in the above-identified patent and that said Letters Patent is hereby corrected as shown below:

Column 13, line 50, delete "means" (first occurrence).

Column 13, line 62, delete "indicting" and insert therefor --indicating--.

Column 13, line 66, after "and" insert --is--.

Column 14, line 9, delete "conveter" and insert therefor --converter--.

Column 14, line 11, delete "a" and insert therefor --an--.

Column 14, line 15, delete "means" (first occurrence).

Column 14, line 54, delete "a" and insert therefor --an--.

Column 14, line 56, delete "mens" and insert therefor --means--.

Column 14, line 62, delete "transform" and insert therefor --transformer--.

Column 15, line 33, delete "capacitopr" and insert therefor --capacitor--.

UNITED STATES PATENT AND TRADEMARK OFFICE

CERTIFICATE OF CORRECTION

PATENT NO. : 4,733,646

DATED : MARCH 29, 1988

INVENTOR(S) : SHIMICHIRO IWASAKI

It is certified that error appears in the above-identified patent and that said Letters Patent is hereby corrected as shown below:

Column 15, line 34, delete "a" and insert therefor --an--.

Column 15, line 35, delete "transmformer" and insert therefor --transformer--.

Column 15, line 48, delete "including" and insert therefor --includes--.

Column 15, line 51, delete "preventing" and insert therefor --prevents--.

Column 16, line 20, delete "OC-DC" and insert therefor --DC-DC--.

Column 16, line 22, delete "a" and insert therefor --an--.

Column 16, line 41, before "turned" insert --is--.

Signed and Sealed this

Fourteenth Day of March, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,733,646

DATED : Mar. 29, 1988

INVENTOR(S) : Shinichiro IWASAKI

It is certified that error appears in the above-identified patent and that said Letters Patent is hereby corrected as shown below:

On the Title page, the inventor's name should be changed from "Shimichiro Iwasaki" to --Shinichiro Iwasaki--.

Signed and Sealed this

Twenty-fifth Day of April, 1989

*Attest:*

DONALD J. QUIGG

*Attesting Officer*

*Commissioner of Patents and Trademarks*